US011230755B2

(12) United States Patent
Sano et al.

(10) Patent No.: US 11,230,755 B2
(45) **Date of Patent: *Jan. 25, 2022**

(54) STEEL SHEET AND PLATED STEEL SHEET

(71) Applicant: NIPPON STEEL & SUMITOMO METAL CORPORATION, Tokyo (JP)

(72) Inventors: Kohichi Sano, Tokyo (JP); Makoto Uno, Tokyo (JP); Ryoichi Nishiyama, Tokyo (JP); Yuji Yamaguchi, Tokyo (JP); Natsuko Sugiura, Tokyo (JP); Masahiro Nakata, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 367 days.

This patent is subject to a terminal disclaimer.

(21) Appl. No.: 16/314,951

(22) PCT Filed: Aug. 4, 2017

(86) PCT No.: PCT/JP2017/028481
§ 371 (c)(1),
(2) Date: Jan. 3, 2019

(87) PCT Pub. No.: WO2018/026016
PCT Pub. Date: Feb. 8, 2018

(65) Prior Publication Data

US 2019/0241996 A1 Aug. 8, 2019

(30) Foreign Application Priority Data

Aug. 5, 2016 (JP) ..... JP2016-155097

(51) Int. Cl.

| | |
|---|---|
| ***C21D 9/46*** | (2006.01) |
| ***C22C 38/38*** | (2006.01) |
| ***C22C 38/58*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/26*** | (2006.01) |
| ***C22C 38/28*** | (2006.01) |
| ***C23C 2/06*** | (2006.01) |
| ***C23C 2/40*** | (2006.01) |

(52) U.S. Cl.
CPC ..... *C22C 38/38* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/26* (2013.01); *C22C 38/28* (2013.01); *C22C 38/58* (2013.01); *C23C 2/06* (2013.01); *C23C 2/40* (2013.01); *C21D 9/46* (2013.01); *C21D 2211/002* (2013.01); *C21D 2211/005* (2013.01)

(58) Field of Classification Search
CPC ..... C21D 9/46
See application file for complete search history.

(56) References Cited

U.S. PATENT DOCUMENTS

| | | | | |
|---|---|---|---|---|
| 10,889,879 | B2 * | 1/2021 | Sano | C23C 2/40 |
| 2003/0063996 | A1 | 4/2003 | Funakawa et al. | |
| 2004/0074573 | A1 | 4/2004 | Funakawa et al. | |
| 2010/0047617 | A1 | 2/2010 | Sugiura et al. | |
| 2010/0108201 | A1 | 5/2010 | Yokoi et al. | |
| 2010/0319819 | A1 | 12/2010 | Kaneko et al. | |
| 2012/0031528 | A1 | 2/2012 | Hayashi et al. | |
| 2015/0071812 | A1 | 3/2015 | Kawano et al. | |
| 2015/0101717 | A1 | 4/2015 | Kosaka et al. | |

(Continued)

FOREIGN PATENT DOCUMENTS

| | | | |
|---|---|---|---|
| CA | 2944863 | A1 | 10/2015 |
| EP | 1350859 | A1 | 10/2003 |

(Continued)

OTHER PUBLICATIONS

International Search Report for PCT/JP2017/028481 dated Oct. 31, 2017.
Written Opinion of the International Searching Authority for PCT/JP2017/028481 (PCT/ISA/237) dated Oct. 31, 2017.
Internetional Preliminary Report on Patentability and English translation of the Written Opinion of the International Searching Authority (Forms PCT/IB/338, PCT/IB/373 and PCT/ISA/237) for International Application No. PCT/JP2017/028481, dated Feb. 14, 2019.
Extended European Search Report for corresponding European Application No. 17837117.5, dated Dec. 5, 2019.

*Primary Examiner* — Jophy S. Koshy
(74) *Attorney, Agent, or Firm* — Birch, Stewart, Kolasch & Birch, LLP

(57) ABSTRACT

A steel sheet has a specific chemical composition and has a structure represented by, by area ratio, ferrite: 0 to 30%, and bainite: 70 to 100%. When a region that is surrounded by a grain boundary having a misorientation of 15° or more and has a circle-equivalent diameter of 0.3 μm or more is defined as a crystal grain, the proportion of crystal grains each having an intragranular misorientation of 5 to 14° to all crystal grains is 20 to 100% by area ratio. A grain boundary number density of solid-solution C or a grain boundary number density of the total of solid-solution C and solid-solution B is 1 piece/$nm^2$ or more and 4.5 pieces/$nm^2$ or less. An average grain size of cementite precipitated at grain boundaries is 2 μm or less.

8 Claims, 1 Drawing Sheet

(56) References Cited

U.S. PATENT DOCUMENTS

| | | | | |
|---|---|---|---|---|
| 2015/0159244 | A1 | 6/2015 | Kobayashi et al. | |
| 2016/0017465 | A1 | 1/2016 | Toda et al. | |
| 2018/0037980 | A1* | 2/2018 | Wakita | C22C 38/38 |
| 2019/0226061 | A1* | 7/2019 | Sano | C22C 38/12 |
| 2019/0309398 | A1* | 10/2019 | Sano | C22C 38/14 |

FOREIGN PATENT DOCUMENTS

| | | | | |
|---|---|---|---|---|
| EP | 2453032 | A1 | 5/2012 | |
| EP | 2599887 | A1 | 6/2013 | |
| EP | 2631314 | A1 | 8/2013 | |
| EP | 2698443 | A1 | 2/2014 | |
| EP | 2885778 | A1 | 4/2015 | |
| EP | 2896715 | A1 | 7/2015 | |
| JP | 6-293910 | A | 10/1994 | |
| JP | 2002-322540 | A | 11/2002 | |
| JP | 2002-322541 | A | 11/2002 | |
| JP | 2005-256115 | A | 9/2005 | |
| JP | 2007-247046 | A | 9/2007 | |
| JP | 2009-19265 | A | 1/2009 | |
| JP | 2009-191360 | A | 8/2009 | |
| JP | 2011-140671 | A | 7/2011 | |
| JP | 2012-1775 | A | 1/2012 | |
| JP | 2014-37595 | A | 2/2014 | |
| JP | 5445720 | B1 | 3/2014 | |
| JP | 2015-124411 | A | 7/2015 | |
| JP | 2016-50334 | A | 4/2016 | |
| WO | WO 2008/056812 | A1 | 5/2008 | |
| WO | WO 2008/123366 | A1 | 10/2008 | |
| WO | WO 2013/161090 | A1 | 10/2013 | |
| WO | WO 2014/002941 | A1 | 1/2014 | |
| WO | WO 2014/014120 | A1 | 1/2014 | |
| WO | WO-2016135896 | A1 * | 9/2016 | C22C 38/26 |

* cited by examiner

STEEL SHEET AND PLATED STEEL SHEET

TECHNICAL FIELD

The present invention relates to a steel sheet and a plated steel sheet.

BACKGROUND ART

Recently, in response to the demand for the reduction in weight of various members aiming at the improvement of fuel efficiency of automobiles, thinning achieved by an increase in strength of a steel sheet of an iron alloy and so on to be used for the members and application of light metal such as an Al alloy to the various members have been in progress. However, when comparing with heavy metal such as steel, the light metal such as an Al alloy has the advantage of being high in specific strength, while has the disadvantage of being significantly expensive. Therefore, the application of light metal such as an Al alloy is limited to special uses. Thus, the thinning achieved by an increase in strength of a steel sheet has been demanded in order to apply the reduction in weight of various members to a more inexpensive and broader range.

When the steel sheet is increased in strength, material properties such as formability (workability) deteriorate generally. Therefore, in the development of a high-strength steel sheet, it is an important task to achieve a high strength without deterioration in the material properties. The steel sheet is required to have ductility, stretch-flanging workability, burring workability, fatigue endurance, impact resistance, corrosion resistance, and so on as usage, and it is important to achieve both these material properties and the strength.

For example, after blanking or hole making is performed by shearing or punching, press forming based on stretch-flanging and burring mainly is performed, and good stretch flangeability is demanded.

In response to the above-described task of good stretch flangeability, for example, Patent Reference 1 discloses that the size of TiC is limited, thereby making it possible to provide a hot-rolled steel sheet excellent in ductility, stretch flangeability, and material uniformity. Further, Patent Reference 2 discloses that types, sizes, and number densities of oxides are defined, thereby making it possible to provide a hot-rolled steel sheet excellent in stretch flangeability and fatigue property. Further, Patent Reference 3 discloses that an area ratio of a ferrite phase and a hardness difference between a ferrite phase and a second phase are defined, thereby making it possible to provide a hot-rolled steel sheet having reduced strength variation and having excellent ductility and hole expandability.

However, in the above-described technique disclosed in Patent Reference 1, it is necessary to secure 95% or more of the ferrite phase in the structure of the steel sheet. Therefore, in order to secure a sufficient strength, 0.08% or more of Ti needs to be contained even when it is set to 480 MPa grade (TS is set to 480 MPa or more). On the other hand, in the steel having 95% or more of a soft ferrite phase, a decrease in ductility becomes an issue when the strength of 480 MPa or more is secured by precipitation strengthening of TiC. Further, in the technique disclosed in Patent Reference 2, addition of rare metals such as La and Ce becomes essential. Thus, the technique disclosed in Patent Reference 2 has a task of alloying element limitation.

Further, as described above, the demand for application of a high-strength steel sheet to automotive members has been growing recently. When the high-strength steel sheet is formed by pressing in cold working, cracking is likely to occur from an edge of a portion to be subjected to stretch flange forming during forming. This is conceivable because work hardening advances only in the edge portion due to the strain introduced into a punched end face at the time of blanking. Conventionally, as an evaluation method of a stretch flangeability test, a hole expansion test has been used. However, in the hole expansion test, the sheet leads to a fracture with little or no strain distributed in a circumferential direction, but in actual part working, a strain distribution exists, and thus the effect on a fracture limit by strain and stress gradient around a fractured portion exists. Accordingly, even when sufficient stretch flangeability is exhibited in the hole expansion test in the case of the high-strength steel sheet, cracking sometimes occurs due to the strain distribution in the case where cold pressing is performed.

Patent References 1, 2 disclose that only the structure to be observed by an optical microscope is defined, to thereby improve the hole expandability. However, it is unclear whether sufficient stretch flangeability can be secured even in the case where the strain distribution is considered. Further, in the steel sheet to be used for such a member, it is concerned that flaws or microcracks occur in an end face formed by shearing or punching and cracking proceeds due to these flaws or microcracks that have occurred, leading to a fatigue failure. Therefore, it is necessary to prevent the occurrence of flaws or microcracks in the end face of the above-described steel sheet in order to improve the fatigue endurance. As these flaws or microcracks that have occurred in the end face, cracks occur parallel to a sheet thickness direction of the end face. This crack is called "peeling." This "peeling" occurs in, particularly, a 540-MPa-grade steel sheet at about 80 percent, and occurs in a 780-MPa-grade steel sheet at 100 percent substantially. Further. this "peeling" occurs without correlation with a hole expansion ratio. For example, even when the hole expansion ratio is 50% or 100%, peeling occurs.

In order to achieve both a high-strength property and various material properties such as formability in particular, in this manner, for example, Patent Reference 4 discloses a method of manufacturing a steel sheet in which high strength and ductility and hole expandability are achieved by setting ferrite to 90% or more and setting the balance to bainite in a steel structure. However, as a result that the present inventors conducted additional tests, in the steel having a composition described in Patent Reference 4, "peeling" occurred after punching.

Further, for example, Patent References 2, 3 disclose a technique of a high-tensile hot-rolled steel sheet that is high in strength and achieves excellent stretch flangeability by adding Mo and making precipitates fine. However, as a result that the present inventors conducted additional tests also on a steel sheet to which the above-described technique disclosed in Patent References 2, 3 is applied, in the steel having a composition described in Patent Reference 5 or 6, "peeling" occurred after punching. Accordingly, it is possible to say that in the technique disclosed in Patent References 2, 3, the technique to suppress flaws or microcracks in an end face formed by shearing or punching is not disclosed at all.

Further, on the other hand, as described above, when the reduction in weight is achieved by thinning, the usable life of an automobile tends to shorten due to corrosion. Furthermore, in order to improve the rust prevention property of the steel sheet, the demand for a plated steel sheet is also growing.

CITATION LIST

Patent Literature

Patent Reference 1: International Publication Pamphlet No. WO2013/161090

Patent Reference 2: Japanese Laid-open Patent Publication No. 2005-256115

Patent Reference 3: Japanese Laid-open Patent Publication No. 2011-140671

Patent Reference 4: Japanese Laid-open Patent Publication No. 06-2933910

Patent Reference 5: Japanese Laid-open Patent Publication No. 2002-322540

Patent Reference 6: Japanese Laid-open Patent Publication No. 2002-322541

SUMMARY OF INVENTION

Technical Problem

An object of the present invention is to provide a steel sheet and a plated steel sheet that are high in strength, have excellent stretch flangeability, and have reduced occurrence of peeling.

Solution to Problem

According to the conventional findings, the improvement of the stretch flangeability (hole expansibility) has been performed by inclusion control, homogenization of structure, unification of structure, and/or reduction in hardness difference between structures, as described in Patent References 1 to 3. In other words, conventionally, the improvement in the stretch flangeability has been achieved by controlling the structure to be observed by an optical microscope.

However, in consideration of the fact that it is impossible to improve the stretch flangeability under the presence of the strain distribution even when only the structure to be observed by an optical microscope is controlled, the present inventors made an intensive study by focusing on an intragranular misorientation of each crystal grain. As a result, they found out that it is possible to greatly improve the stretch flangeability by controlling the proportion of crystal grains each having a misorientation in a crystal grain of 5 to 14° to all crystal grains to 20 to 100%.

Further, the present inventors found out that as long as a grain boundary number density of solid-solution C or a grain boundary number density of the total of solid-solution C and solid-solution B is 1 piece/nm$^2$ or more and 4.5 pieces/nm$^2$ or less and an average grain size of cementite precipitated at grain boundaries in a steel sheet is 2 μm or less, it is also possible to suppress the peeling and suppress cracks from an end face, resulting in that it is possible to further improve the stretch flangeability.

The gist of the present invention is as follows.

(1)

A steel sheet, contains:

a chemical composition represented by, in mass %,

C: 0.008 to 0.150%,

Si: 0.01 to 1.70%,

Mn: 0.60 to 2.50%,

Al: 0.010 to 0.60%,

Ti: 0 to 0.200%,

Nb: 0 to 0.200%,

Ti+Nb: 0.015 to 0.200%,

Cr: 0 to 1.0%,

B: 0 to 0.10%,

Mo: 0 to 1.0%,

Cu: 0 to 2.0%,

Ni: 0 to 2.0%,

Mg: 0 to 0.05%,

REM: 0 to 0.05%,

Ca: 0 to 0.05%,

Zr: 0 to 0.05%,

P: 0.05% or less,

S: 0.0200% or less,

N: 0.0060% or less, and balance: Fe and impurities; and a structure represented by, by area ratio, ferrite: 0 to 30%, and bainite: 70 to 100%, in which when a region that is surrounded by a grain boundary having a misorientation of 15° or more and has a circle-equivalent diameter of 0.3 μm or more is defined as a crystal grain, the proportion of crystal grains each having an intragranular misorientation of 5 to 14° to all crystal grains is 20 to 100% by area ratio, a grain boundary number density of solid-solution C or a grain boundary number density of the total of solid-solution C and solid-solution B is 1 piece/nm$^2$ or more and 4.5 pieces/nm$^2$ or less, and an average grain size of cementite precipitated at grain boundaries is 2 μm or less.

(2)

The steel sheet according to (1), in which a tensile strength is 480 MPa or more, and the product of the tensile strength and a limit form height in a saddle-type stretch-flange test is 19500 mm·MPa or more.

(3)

The steel sheet according to (1) or (2), in which the chemical composition contains, in mass %, one type or more selected from the group consisting of Cr: 0.05 to 1.0%, and B: 0.0005 to 0.10%.

(4)

The steel sheet according to any one of (1) to (3), in which the chemical composition contains, in mass %, one type or more selected from the group consisting of Mo: 0.01 to 1.0%, Cu: 0.01 to 2.0%, and Ni: 0.01% to 2.0%.

(5)

The steel sheet according to any one of (1) to (4), in which the chemical composition contains, in mass %, one type or more selected from the group consisting of Ca: 0.0001 to 0.05%, Mg: 0.0001 to 0.05%, Zr: 0.0001 to 0.05%, and REM: 0.0001 to 0.05%.

(6)

A plated steel sheet, in which a plating layer is formed on a surface of the steel sheet according to any one of (1) to (5).

(7)

The plated steel sheet according to (6), in which the plating layer is a hot-dip galvanizing layer.

(8)

The plated steel sheet according to (6), in which the plating layer is an alloyed hot-dip galvanizing layer.

Advantageous Effects of Invention

According to the present invention, it is possible to provide a steel sheet and a plated steel sheet that are high in strength, have excellent stretch flangeability, and have reduced occurrence of peeling. According to the present invention, it is possible to provide a steel sheet and a plated steel sheet excellent in surface property and burring property that are excellent in strict stretch flangeability and resistance to cracks (peeling) in a member end face formed by shearing or punching, in particular, and have a steel sheet grade of 540 MPa grade or more and further 780 MPa or more while having high strength. The steel sheet and the plated steel sheet of the present invention are applicable to members required to have strict ductility and stretch flangeability while having high strength.

DESCRIPTION OF EMBODIMENTS

Figure 1A:
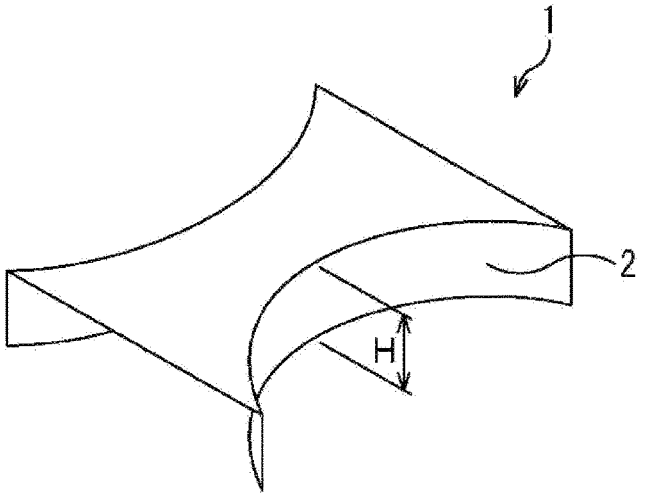
FIG. 1A is a perspective view illustrating a saddle-type formed product to be used for a saddle-type stretch-flange test method.

Hereinafter, there will be explained embodiments of the present invention.

[Chemical Composition]

First, there will be explained a chemical composition of a steel sheet according to the embodiment of the present invention. In the following explanation, "%" that is a unit of the content of each element contained in the steel sheet means "mass %" unless otherwise stated. The steel sheet according to this embodiment has a chemical composition represented by C: 0.008 to 0.150%, Si: 0.01 to 1.70%, Mn: 0.60 to 2.50%, Al: 0.010 to 0.60%, Ti: 0 to 0.200%, Nb: 0 to 0.200%, Ti+Nb: 0.015 to 0.200%, Cr: 0 to 1.0%, B: 0 to 0.10%, Mo: 0 to 1.0%, Cu: 0 to 2.0%, Ni: 0 to 2.0%, Mg: 0 to 0.05%, rare earth metal (REM): 0 to 0.05%, Ca: 0 to 0.05%, Zr: 0 to 0.05%, P: 0.05% or less, S: 0.0200% or less, N: 0.0060% or less, and balance: Fe and impurities. Examples of the impurities include one contained in raw materials such as ore and scrap, and one contained during a manufacturing process.

"C: 0.008 to 0.150%"

C bonds to Nb, Ti, and so on to form precipitates in the steel sheet and contributes to an improvement in strength of steel by precipitation strengthening. When the C content is less than 0.008%, it is impossible to sufficiently obtain this effect. Therefore, the C content is set to 0.008% or more. The C content is preferably set to 0.010% or more, and more preferably set to 0.018% or more. On the other hand, when the C content is greater than 0.150%, an orientation spread in bainite is likely to increase and the proportion of crystal grains each having an intragranular misorientation of 5 to 14° becomes short. Further, when the C content is greater than 0.150%, cementite harmful to the stretch flangeability increases and the stretch flangeability deteriorates. Therefore, the C content is set to 0.150% or less. The C content is preferably set to 0.100% or less and more preferably set to 0.090% or less.

"Si: 0.01 to 1.70%"

Si functions as a deoxidizer for molten steel. When the Si content is less than 0.01%, it is impossible to sufficiently obtain this effect. Therefore, the Si content is set to 0.01% or more. The Si content is preferably set to 0.02% or more and more preferably set to 0.03% or more. On the other hand, when the Si content is greater than 1.70%, the stretch flangeability deteriorates or surface flaws occur. Further, when the Si content is greater than 1.70%, the transformation point rises too much, to then require an increase in rolling temperature. In this case, recrystallization during hot rolling is promoted significantly and the proportion of the crystal grains each having an intragranular misorientation of 5 to 14° becomes short. Further, when the Si content is greater than 1.70%, surface flaws are likely to occur when a plating layer is formed on the surface of the steel sheet. Therefore, the Si content is set to 1.70% or less. The Si content is preferably set to 1.60% or less, more preferably set to 1.50% or less, and further preferably set to 1.40% or less.

"Mn: 0.60 to 2.50%"

Mn contributes to the strength improvement of the steel by solid-solution strengthening or improving hardenability of the steel. When the Mn content is less than 0.60%, it is impossible to sufficiently obtain this effect. Therefore, the Mn content is set to 0.60% or more. The Mn content is preferably set to 0.70% or more and more preferably set to 0.80% or more. On the other hand, when the Mn content is greater than 2.50%, the hardenability becomes excessive and the degree of orientation spread in bainite increases. As a result, the proportion of the crystal grains each having an intragranular misorientation of 5 to 14° becomes short and the stretch flangeability deteriorates. Therefore, the Mn content is set to 2.50% or less. The Mn content is preferably set to 2.30% or less and more preferably set to 2.10% or less.

"Al: 0.010 to 0.60%"

Al is effective as a deoxidizer for molten steel. When the Al content is less than 0.010%, it is impossible to sufficiently obtain this effect. Therefore, the Al content is set to 0.010% or more. The Al content is preferably set to 0.020% or more and more preferably set to 0.030% or more. On the other hand, when the Al content is greater than 0.60%, weldability, toughness, and so on deteriorate. Therefore, the Al content is set to 0.60% or less. The Al content is preferably set to 0.50% or less and more preferably set to 0.40% or less.

"Ti: 0 to 0.200%, Nb: 0 to 0.200%, Ti+Nb: 0.015 to 0.200%"

Ti and Nb finely precipitate in the steel as carbides (TiC, NbC) and improve the strength of the steel by precipitation strengthening. Further, Ti and Nb form carbides to thereby fix C, resulting in that generation of cementite harmful to the stretch flangeability is suppressed. Further, Ti and Nb can significantly improve the proportion of the crystal grains each having an intragranular misorientation of 5 to 14° and improve the stretch flangeability while improving the strength of the steel. When the total content of Ti and Nb is less than 0.015%, the workability deteriorates and the frequency of cracking during rolling increases. Therefore, the total content of Ti and Nb is set to 0.015% or more and preferably set to 0.018% or more. Further, the Ti content is preferably set to 0.015% or more, more preferably set to 0.020% or more, and further preferably set to 0.025% or more. Further, the Nb content is preferably set to 0.015% or more, more preferably set to 0.020% or more, and further preferably set to 0.025% or more. On the other hand, when the total content of Ti and Nb is greater than 0.200%, the proportion of the crystal grains each having an intragranular misorientation of 5 to 14° becomes short and the stretch flangeability deteriorates. Therefore, the total content of Ti and Nb is set to 0.200% or less and preferably set to 0.150% or less. Further, when the Ti content is greater than 0.200%, the ductility deteriorates. Therefore, the Ti content is set to 0.200% or less. The Ti content is preferably set to 0.180% or less and more preferably set to 0.160% or less. Further, when the Nb content is greater than 0.200%, the ductility deteriorates. Therefore, the Nb content is set to 0.200% or less. The Nb content is preferably set to 0.180% or less and more preferably set to 0.160% or less.

"P: 0.05% or Less"

P is an impurity. P deteriorates toughness, ductility, weldability, and so on, and thus a lower P content is more preferable. When the P content is greater than 0.05%, the deterioration in stretch flangeability is prominent. Therefore, the P content is set to 0.05% or less. The P content is preferably set to 0.03% or less and more preferably set to 0.02% or less. The lower limit of the P content is not determined in particular, but its excessive reduction is not desirable from the viewpoint of manufacturing cost. Therefore, the P content may be set to 0.005% or more.

"S: 0.0200% or Less"

S is an impurity. S causes cracking at the time of hot rolling, and further forms A-based inclusions that deteriorate the stretch flangeability. Thus, a lower S content is more preferable. When the S content is greater than 0.0200%, the deterioration in stretch flangeability is prominent. Therefore, the S content is set to 0.0200% or less. The S content is preferably set to 0.0150% or less and more preferably set to 0.0060% or less. The lower limit of the S content is not determined in particular, but its excessive reduction is not desirable from the viewpoint of manufacturing cost. Therefore, the S content may be set to 0.0010% or more.

"N: 0.0060% or Less"

N is an impurity. N forms precipitates with Ti and Nb preferentially over C and reduces Ti and Nb effective for fixation of C. Thus, a lower N content is more preferable. When the N content is greater than 0.0060%, the deterioration in stretch flangeability is prominent. Therefore, the N content is set to 0.0060% or less. The N content is preferably set to 0.0050% or less. The lower limit of the N content is not determined in particular, but its excessive reduction is not desirable from the viewpoint of manufacturing cost. Therefore, the N content may be set to 0.0010% or more.

Cr, B, Mo, Cu, Ni, Mg, REM, Ca, and Zr are not essential elements, but are arbitrary elements that may be contained as needed in the steel sheet up to predetermined amounts.

"Cr: 0 to 1.0%"

Cr contributes to the strength improvement of the steel. Desired purposes are achieved without Cr being contained, but in order to sufficiently obtain this effect, the Cr content is preferably set to 0.05% or more. On the other hand, when the Cr content is greater than 1.0%, the above-described effect is saturated and economic efficiency decreases. Therefore, the Cr content is set to 1.0% or less.

"B: 0 to 0.10%"

B increases a grain boundary strength in the case of segregating to grain boundaries to exist with solid-solution C. In order to sufficiently obtain this effect, the B content is preferably set to 0.0002% or more. Further, B improves the hardenability to facilitate formation of a continuous cooling transformation structure being a favorable microstructure for the burring property. Therefore, the B content is more preferably set to 0.0005% or more and further preferably set to 0.001% or more. However, in the case where only the solid-solution B exists at the grain boundaries and the solid-solution C does not exist at the grain boundaries, the grain boundary strengthening effect is not as large as that provided by the solid-solution C, and thus, the "peeling" is likely to occur. Further, in the case where no B is contained, when a coiling temperature is 650° C. or less, some of B that is a grain boundary segregation element is replaced with the solid-solution C to contribute to the strength improvement of the grain boundaries, but when the coiling temperature is greater than 650° C., the grain boundary number density of the total of the solid-solution C and the solid-solution B becomes less than 1 piece/$nm^2$, and thus it is estimated that fracture surface cracking occurs. On the other hand, when the B content is greater than 0.10%, the above-described effect is saturated and economic efficiency decreases. Therefore, the B content is set to 0.10% or less. Further, when the B content is greater than 0.002%, slab cracking sometimes occurs. Thus, the B content is preferably set to 0.002% or less.

"Mo: 0 to 1.0%"

Mo improves the hardenability, and at the same time, has an effect of increasing the strength by forming carbides. Desired purposes are achieved without Mo being contained, but in order to sufficiently obtain this effect, the Mo content is preferably set to 0.01% or more. On the other hand, when the Mo content is greater than 1.0%, the ductility and the weldability sometimes decrease. Therefore, the Mo content is set to 1.0% or less.

"Cu: 0 to 2.0%"

Cu increases the strength of the steel sheet, and at the same time, improves corrosion resistance and removability of scales. Desired purposes are achieved without Cu being contained, but in order to sufficiently obtain this effect, the Cu content is preferably set to 0.01% or more and more preferably set to 0.04% or more. On the other hand, when the Cu content is greater than 2.0%, surface flaws sometimes occur. Therefore, the Cu content is set to 2.0% or less and preferably set to 1.0% or less.

"Ni: 0 to 2.0%"

Ni increases the strength of the steel sheet, and at the same time, improves the toughness. Desired purposes are achieved without Ni being contained, but in order to sufficiently obtain this effect, the Ni content is preferably set to 0.01% or more. On the other hand, when the Ni content is greater than 2.0%, the ductility decreases. Therefore, the Ni content is set to 2.0% or less.

"Mg: 0 to 0.05%, REM: 0 to 0.05%, Ca: 0 to 0.05%, Zr: 0 to 0.05%"

Ca, Mg, Zr, and REM all improve toughness by controlling shapes of sulfides and oxides. Desired purposes are achieved without Ca, Mg, Zr, and REM being contained, but in order to sufficiently obtain this effect, the content of one type or more selected from the group consisting of Ca, Mg, Zr, and REM is preferably set to 0.0001% or more and more preferably set to 0.0005% or more. On the other hand, when the content of Ca, Mg, Zr, or REM is greater than 0.05%, the stretch flangeability deteriorates. Therefore, the content of each of Ca, Mg, Zr, and REM is set to 0.05% or less.

"Metal Structure"

Next, there will be explained a structure (metal structure) of the steel sheet according to the embodiment of the present invention. In the following explanation, "%" that is a unit of the proportion (area ratio) of each structure means "area %" unless otherwise stated. The steel sheet according to this embodiment has a structure represented by ferrite: 0 to 30% and bainite: 70 to 100%.

"Ferrite: 0 to 30%"

When the area ratio of the ferrite is 30% or less, it is possible to increase the ductility without great deterioration in the burring property. Further, ferrite is transformed while C accumulating in crystal grains, and thus the solid-solution C tends to decrease at the grain boundaries. On the other hand, when the area ratio of the ferrite exceeds 30%, it becomes difficult to control the grain boundary number density of the solid-solution C to fall within a range of 1 piece/nm$^2$ or more and 4.5 pieces/nm$^2$ or less. Therefore, the area ratio of the ferrite is set to 0 to 30%.

"Bainite: 70 to 100%"

Bainite is set to the main phase, thereby making it possible to increase the stretch-flanging and the burring workability. In order to obtain this effect sufficiently, the area ratio of the bainite is set to 70 to 100%.

The structure of the steel sheet may contain pearlite or martensite or both of these. The pearlite is good in fatigue property and stretch flangeability similarly to the bainite. When pearlite and bainite are compared, the bainite is better in fatigue property of a punched portion. The area ratio of the pearlite is preferably set to 0 to 15%. When the area ratio of the pearlite is in this range, it is possible to obtain a steel sheet having a punched portion with a better fatigue property. The martensite adversely affects the stretch flangeability, and thus the area ratio of the martensite is preferably set to 10% or less. The area ratio of the structure other than the ferrite, the bainite, the pearlite, and the martensite is preferably set to 10% or less, more preferably set to 5% or less, and further preferably set to 3% or less.

The proportion (area ratio) of each structure can be obtained by the following method. First, a sample collected from the steel sheet is etched by nital. After the etching, a structure photograph obtained at a ¼ depth position of the sheet thickness in a visual field of 300 μm×300 μm is subjected to an image analysis by using an optical microscope. By this image analysis, the area ratio of ferrite, the area ratio of pearlite, and the total area ratio of bainite and martensite are obtained. Then, a sample etched by LePera is used, and a structure photograph obtained at a ¼ depth position of the sheet thickness in a visual field of 300 μm×300 μm is subjected to an image analysis by using an optical microscope. By this image analysis, the total area ratio of retained austenite and martensite is obtained. Further, a sample obtained by grinding the surface to a depth of ¼ of the sheet thickness from a direction normal to a rolled surface is used, and the volume fraction of retained austenite is obtained through an X-ray diffraction measurement. The volume fraction of the retained austenite is equivalent to the area ratio, and thus is set as the area ratio of the retained austenite. Then, the area ratio of martensite is obtained by subtracting the area ratio of the retained austenite from the total area ratio of the retained austenite and the martensite, and the area ratio of bainite is obtained by subtracting the area ratio of the martensite from the total area ratio of the bainite and the martensite. In this manner, it is possible to obtain the area ratio of each of ferrite, bainite, martensite, retained austenite, and pearlite.

In the steel sheet according to this embodiment, in the case where a region surrounded by a grain boundary having a misorientation of 15° or more and having a circle-equivalent diameter of 0.3 μm or more is defined as a crystal grain, the proportion of crystal grains each having an intragranular misorientation of 5 to 14° to all crystal grains is 20 to 100% by area ratio. The intragranular misorientation is obtained by using an electron back scattering diffraction (EBSD) method that is often used for a crystal orientation analysis. The intragranular misorientation is a value in the case where a boundary having a misorientation of 15° or more is set as a grain boundary in a structure and a region surrounded by this grain boundary is defined as a crystal grain.

The crystal grains each having an intragranular misorientation of 5 to 14° are effective for obtaining a steel sheet excellent in the balance between strength and workability. The proportion of the crystal grains each having an intragranular misorientation of 5 to 14° is increased, thereby making it possible to improve the stretch flangeability while maintaining desired strength of the steel sheet. When the proportion of the crystal grains each having an intragranular misorientation of 5 to 14° to all the crystal grains is 20% or more by area ratio, desired strength and stretch flangeability of the steel sheet can be obtained. It does not matter that the proportion of the crystal grains each having an intragranular misorientation of 5 to 14° is high, and thus its upper limit is 100%.

A cumulative strain at the final three stages of finish rolling is controlled as will be described later, and thereby crystal misorientation occurs in grains of ferrite and bainite. The reason for this is considered as follows. By controlling the cumulative strain, dislocation in austenite increases, dislocation walls are made in an austenite grain at a high density, and some cell blocks are formed. These cell blocks have different crystal orientations. It is conceivable that austenite that has a high dislocation density and contains the cell blocks having different crystal orientations is transformed, and thereby, ferrite and bainite also include crystal misorientations even in the same grain and the dislocation density also increases. Thus, the intragranular crystal misorientation is conceived to correlate with the dislocation density contained in the crystal grain. Generally, the increase in the dislocation density in a grain brings about an improvement in strength, but lowers the workability. However, the crystal grains each having an intragranular misorientation controlled to 5 to 14° make it possible to improve the strength without lowering the workability. Therefore, in the steel sheet according to this embodiment, the proportion of the crystal grains each having an intragranular misorientation of 5 to 14° is set to 20% or more. The crystal grains each having an intragranular misorientation of less than 5° are excellent in workability, but have difficulty in increasing the strength. The crystal grains each having an intragranular misorientation of greater than 14° do not contribute to the improvement in stretch flangeability because they are different in deformability among the crystal grains.

The proportion of the crystal grains each having an intragranular misorientation of 5 to 14° can be measured by the following method. First, at a ¼ depth position of a sheet thickness t from the surface of the steel sheet (¼ t portion) in a cross section vertical to a rolling direction, a region of 200 μm in the rolling direction and 100 μm in a direction normal to the rolled surface is subjected to an EBSD analysis at a measurement pitch of 0.2 μm to obtain crystal orientation information. Here, the EBSD analysis is performed by using an apparatus that is composed of a thermal field emission scanning electron microscope (JSM-7001F manufactured by JEOL Ltd.) and an EBSD detector (HIKARI detector manufactured by TSL Co., Ltd.), at an analysis speed of 200 to 300 points/second. Then, with respect to the obtained crystal orientation information, a region having a misorientation of 15° or more and a circle-equivalent diameter of 0.3 μm or more is defined as a crystal grain, the average intragranular misorientation of crystal grains is calculated, and the proportion of the crystal grains each having an intragranular misorientation of 5 to 14° is obtained. The crystal grain defined as described above and the average intragranular misorientation can be calculated by using software "OIM Analysis (registered trademark)" attached to an EBSD analyzer. The "intragranular misorientation" in this embodiment means "Grain Orientation Spread (GOS)" that is an orientation spread in a crystal grain. The value of the intragranular misorientation is obtained as an average value of misorientations between the reference crystal orientation and all measurement points in the same crystal grain as described in "Misorientation Analysis of Plastic Deformation of Stainless Steel by EBSD and X-ray Diffraction Methods," KIMURA Hidehiko, et al., Transactions of the Japan Society of Mechanical Engineers (series A), Vol. 71, No. 712, 2005, p. 1722-1728. In this embodiment, the reference crystal orientation is an orientation obtained by averaging all the measurement points in the same crystal grain. The value of GOS can be calculated by using software "OIM Analysis (registered trademark) Version 7.0.1" attached to the EBSD analyzer.

Figure 1B:
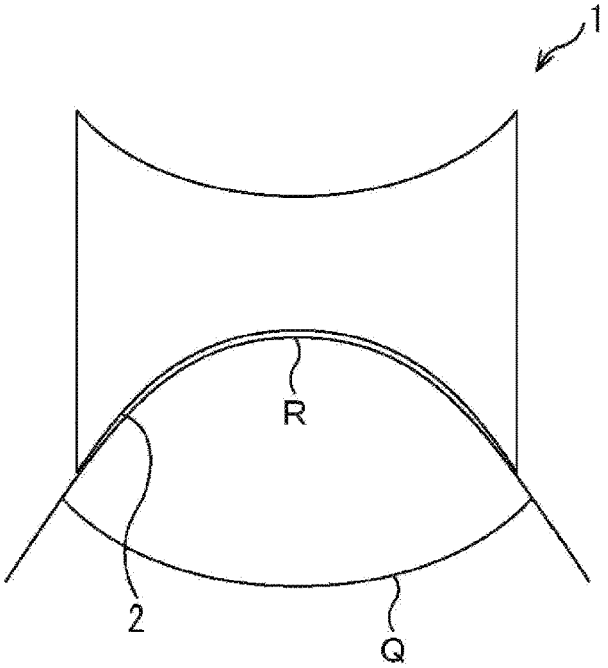
FIG. 1B is a plan view illustrating the saddle-type formed product to be used for the saddle-type stretch-flange test method.

In this embodiment, the stretch flangeability is evaluated by a saddle-type stretch-flange test method using a saddle-type formed product. FIG. 1A and FIG. 1B are views each illustrating a saddle-type formed product to be used for a saddle-type stretch-flange test method in this embodiment, FIG. 1A is a perspective view, and FIG. 1B is a plan view. In the saddle-type stretch-flange test method, concretely, a saddle-type formed product 1 simulating the stretch flange shape formed of a linear portion and an arc portion as illustrated in FIG. 1A and FIG. 1B is pressed, and the stretch flangeability is evaluated by using a limit form height at that time. In the saddle-type stretch-flange test method in this embodiment, a limit form height H (mm) obtained when a clearance at the time of punching a corner portion 2 is set to 11% is measured by using the saddle-type formed product 1 in which a radius of curvature R of the corner portion 2 is set to 50 to 60 mm and an opening angle θ of the corner portion 2 is set to 120°. Here, the clearance indicates the ratio of a gap between a punching die and a punch and the thickness of the test piece. Actually, the clearance is determined by the combination of a punching tool and the sheet thickness, to thus mean that 11% satisfies a range of 10.5 to 11.5%. As for determination of the limit form height H, whether or not a crack having a length of ⅓ or more of the sheet thickness exists is visually observed after forming, and then a limit form height with no existence of cracks is determined as the limit form height.

In a conventional hole expansion test used as a test method coping with the stretch flangeability, the sheet leads to a fracture with little or no strain distributed in a circumferential direction. Therefore, the strain and the stress gradient around a fractured portion differ from those at an actual stretch flange forming time. Further, in the hole expansion test, evaluation is made at the point in time when a fracture occurs penetrating the sheet thickness, or the like, resulting in that the evaluation reflecting the original stretch flange forming is not made. On the other hand, in the saddle-type stretch-flange test used in this embodiment, the stretch flangeability considering the strain distribution can be evaluated, and thus the evaluation reflecting the original stretch flange forming can be made.

According to the steel sheet according to this embodiment, a tensile strength of 480 MPa or more can be obtained. That is, an excellent tensile strength can be obtained. The upper limit of the tensile strength is not limited in particular. However, in a component range in this embodiment, the upper limit of the practical tensile strength is about 1180 MPa. The tensile strength can be measured by fabricating a No. 5 test piece described in JIS-Z2201 and performing a tensile test according to a test method described in JIS-Z2241.

According to the steel sheet according to this embodiment, the product of the tensile strength and the limit form height in the saddle-type stretch-flange test, which is 19500 mm·MPa or more, can be obtained. That is, excellent stretch flangeability can be obtained. The upper limit of this product is not limited in particular. However, in a component range in this embodiment, the upper limit of this practical product is about 25000 mm·MPa.

In the steel sheet according to this embodiment, the area ratios of the respective structures observed by an optical microscope such as ferrite and bainite and the proportion of the crystal grains each having an intragranular misorientation of 5 to 14° have no direct relation. In other words, for example, even if there are steel sheets having the same area ratio of ferrite and the same area ratio of bainite, they are not necessarily the same in the proportion of the crystal grains each having an intragranular misorientation of 5 to 14°. Accordingly, it is impossible to obtain properties equivalent to those of the steel sheet according to this embodiment only by controlling the area ratio of ferrite and the area ratio of bainite.

In the steel sheet according to this embodiment, the grain boundary number density of the solid-solution C or the grain boundary number density of the total of the solid-solution C and the solid-solution B is 1 piece/nm$^2$ or more and 4.5 pieces/nm$^2$ or less. The grain boundary number density of the solid-solution C or the grain boundary number density of the total of the solid-solution C and the solid-solution B is set to 1 piece/nm$^2$ or more and 4.5 pieces/nm$^2$ or less, thereby making it possible to improve the stretch flangeability without causing the "peeling." This is conceivable because the solid-solution C and the solid-solution B strengthen the grain boundaries. Thus, in order to obtain this effect, the grain boundary number density of the solid-solution C or the grain boundary number density of the total of the solid-solution C and the solid-solution B is set to 1 piece/nm$^2$ or more. On the other hand, when the grain boundary number density of the solid-solution C or the grain boundary number density of the total of the solid-solution C and the solid-solution B exceeds 4.5 pieces/nm$^2$, the stretch flangeability decreases. This is estimated because the solid-solution C and the solid-solution B in too large amounts exist at the grain boundaries to make the grain boundaries brittle. Thus, the grain boundary number density of the solid-solution C or the grain boundary number density of the total of the solid-solution C and the solid-solution B is set to 4.5 pieces/nm$^2$ or less.

In the steel sheet according to this embodiment, the average grain size of cementite precipitated at the grain boundaries is 2 μm or less. The average grain size of cementite precipitated at the grain boundaries is set to 2 μm or less, thereby making it possible to improve the stretch flangeability. In the stretch flange forming, voids occur during the forming to be connected, to thereby cause cracking. Thus, when coarse cementite exists at the grain boundaries, the cementite cracks at the time of forming, resulting in that voids are likely to occur. Incidentally, no problem is caused even when cementite that forms pearlite lamellas exists. This is conceivable because the cementite does not crack easily thanks to its shape or the cementite is sandwiched by a phases, and thus voids do not occur easily. A smaller average grain size of the cementite is more preferable, and thus the average grain size is preferably set to 1.5 μm or less and more preferably set to 1.0 μm or less.

The average grain size of the cementite precipitated at the grain boundaries is observed by a transmission electron microscope equipped with a field emission gun (FEG) having an accelerating voltage of 200 kV by collecting a sample for the transmission electron microscope from the ¼ thickness of a sample cut out from the position of ¼W or ¾W of the sheet width of a steel sheet of a sample steel. Precipitates observed at the grain boundaries can be confirmed to be cementite by analyzing a diffraction pattern. Incidentally, the average grain size of the cementite in this embodiment is defined as the average value calculated from measured values obtained by measuring grain sizes of all cementite particles observed in a single visual field.

In order to measure the solid-solution C and the solid-solution B that exist at the grain boundaries and inside the grains, a three-dimensional atom probe method is used. A position sensitive atom probe (PoSAP) is used in the three-dimensional atom probe method. The position sensitive atom probe is an apparatus developed in 1988 by A. Cerezo et al. at Oxford University. This apparatus is an apparatus that is provided with a position sensitive detector as a detector for the atom probe and is capable of simultaneously measuring the flight time and the position of atoms that have reached the detector without using an aperture when performing an analysis.

Using this apparatus makes it possible not only to display all the compositional elements in the alloy existing on the surface of the sample with atomic-level spatial resolution as a two-dimensional map, but also to display•analyze them as a three-dimensional map by using a field evaporation phenomenon to evaporate one atomic layer at a time from the surface of the sample and expanding the two-dimensional map in a depth direction. For the grain boundary observation, a FIB (focused ion beam) apparatus (FB2000A manufactured by Hitachi, Ltd.) is used for fabricating a needle-shaped sample for AP containing a grain boundary portion, and the grain boundary portion is formed into a needle tip portion by a scanning beam having an arbitrary shape in order to form the cut sample into a needle shape by electrolytic polishing. The sample is observed to specify the grain boundary by utilizing the mechanism in which contrast is exhibited in crystal grains having different orientations due to a channeling phenomenon of a SIM (scanning ion microscope) to then be cut by an ion beam. The position sensitive atom probe is an OTAP manufactured by CAMECA. As the measurement condition, a sample position temperature is set to about 70 K, a probe total voltage is set to 10 to 15 kV, and a pulse ratio is set to 25%. The grain boundary and the grain interior of each sample are measured three times, and the average value of measurements is set as a representative value. The value obtained by removing background noise and so on from a measured value is defined as an atom density per unit grain boundary area to be set as the grain boundary number density (grain boundary segregation density) (piece/nm$^2$). Accordingly, the solid-solution C that exists at the grain boundaries is surely the C atom existing at the grain boundaries. Further, the solid-solution B that exists at the grain boundaries is surely the B atom existing at the grain boundaries.

The grain boundary number density of the solid-solution C in this embodiment is defined as the number (density) per grain boundary unit area of the solid-solution C existing at the grain boundaries. The grain boundary number density of the solid-solution B in this embodiment is defined as the number (density) per grain boundary unit area of the solid-solution B existing at the grain boundaries. According to the three-dimensional atom probe method, the atom map reveals the distribution of atoms three-dimensionally, thereby making it possible to confirm that there are a large number of C atoms and a large number of B atoms at the position of the grain boundary. Incidentally, in the case of precipitates, they can be specified by the number of atoms and the positional relationship relative to other atoms (such as Ti).

Next, there will be explained a method of manufacturing the steel sheet according to the embodiment of the present invention. In this method, hot rolling, air cooling, first cooling, and second cooling are performed in this order.

"Hot Rolling"

The hot rolling includes rough rolling and finish rolling. In the hot rolling, a slab (steel billet) having the above-described chemical composition is heated to be subjected to rough rolling. A slab heating temperature is set to SRTmin° C. expressed by Expression (1) below or more and 1260° C. or less.

$$SRT\,\mathrm{min}=[7000/\{2.75-\log([\mathrm{Ti}]\times[\mathrm{C}])\}-273)+10000/\{4.29-\log([\mathrm{Nb}]\times[\mathrm{C}])\}-273)]/2 \quad (1)$$

Here, [Ti], [Nb], and [C] in Expression (1) represent the contents of Ti, Nb, and C in mass %.

When the slab heating temperature is less than SRTmin° C., Ti and/or Nb are/is not sufficiently brought into solution. When Ti and/or Nb are/is not brought into solution at the time of slab heating, it becomes difficult to make Ti and/or Nb finely precipitate as carbides (TiC, NbC) and improve the strength of the steel by precipitation strengthening. Further, when the slab heating temperature is less than SRTmin° C., it becomes difficult to fix C by formation of the carbides (TiC, NbC) to suppress generation of cementite harmful to a burring property. Further, when the slab heating temperature is less than SRTmin° C., the proportion of the crystal grains each having an intragranular crystal misorientation of 5 to 14° is likely to be short. Therefore, the slab heating temperature is set to SRTmin° C. or more. On the other hand, when the slab heating temperature is greater than 1260° C., the yield decreases due to scale-off. Therefore, the slab heating temperature is set to 1260° C. or less.

After the slab heating, the slab extracted from a heating furnace without waiting, in particular, is subjected to rough rolling, and then a rough bar is obtained. When a finishing temperature of the rough rolling is less than 1000° C., hot deformation resistance during the rough rolling increases to cause a difficulty in the operation of the rough rolling in some cases. Therefore, the finishing temperature of the rough rolling is set to 1000° C. or more. On the other hand, when the finishing temperature of the rough rolling exceeds 1150° C., the grain boundary number density of the solid-solution C in the grain boundaries sometimes becomes 1 piece/nm$^2$ or less. This is estimated because Ti and Nb precipitate in austenite as coarse TiC and NbC and the solid-solution C decreases. Further, when the finishing temperature of the rough rolling exceeds 1150° C., a hot-rolled sheet strength sometimes decreases. This is because TiC and NbC precipitate coarsely.

When a time period between finish of the rough rolling and start of finish rolling exceeds 150 seconds, the grain boundary number density of the solid-solution C in the grain boundaries sometimes becomes 1 piece/nm$^2$ or less. This is estimated because Ti and Nb precipitate in austenite as coarse TiC and NbC and the solid-solution C decreases. Further, the hot-rolled sheet strength sometimes decreases. This is because TiC and NbC precipitate coarsely. On the other hand, when the time period between finish of the rough rolling and start of the finish rolling is less than 30 seconds, before start of the finish rolling and between passes, blisters that become the starting points of scale or spindle scale defects occur between surface scales on the base iron of the steel sheet, and thus these scale defects are likely to be generated in some cases.

By the finish rolling, a hot-rolled steel sheet is obtained. The cumulative strain at the final three stages (final three passes) in the finish rolling is set to 0.5 to 0.6 in order to set the proportion of the crystal grains each having an intragranular misorientation of 5 to 14° to 20% or more, and then later-described cooling is performed. This is due to the following reason. The crystal grains each having an intragranular misorientation of 5 to 14° are generated by being transformed in a paraequilibrium state at relatively low temperature. Therefore, the dislocation density of austenite before transformation is limited to a certain range in the hot rolling, and at the same time, the subsequent cooling rate is limited to a certain range, thereby making it possible to control generation of the crystal grains each having an intragranular misorientation of 5 to 14°.

That is, the cumulative strain at the final three stages in the finish rolling and the subsequent cooling are controlled, thereby making it possible to control the nucleation frequency of the crystal grains each having an intragranular misorientation of 5 to 14° and the subsequent growth rate. As a result, it is possible to control the area ratio of the crystal grains each having an intragranular misorientation of 5 to 14° in a steel sheet to be obtained after cooling. More concretely, the dislocation density of the austenite introduced by the finish rolling is mainly related to the nucleation frequency and the cooling rate after the rolling is mainly related to the growth rate.

When the cumulative strain at the final three stages in the finish rolling is less than 0.5, the dislocation density of the austenite to be introduced is not sufficient and the proportion of the crystal grains each having an intragranular misorientation of 5 to 14° becomes less than 20%. Therefore, the cumulative strain at the final three stages is set to 0.5 or more. On the other hand, when the cumulative strain at the final three stages in the finish rolling exceeds 0.6, recrystallization of the austenite occurs during the hot rolling and the accumulated dislocation density at a transformation time decreases. As a result, the proportion of the crystal grains each having an intragranular misorientation of 5 to 14° becomes less than 20%. Therefore, the cumulative strain at the final three stages is set to 0.6 or less.

The cumulative strain at the final three stages in the finish rolling (εeff.) is obtained by Expression (2) below.

$$\varepsilon\text{eff.}=\Sigma\varepsilon i(t,T) \tag{2}$$

Here, $$\varepsilon i(t,T)=\varepsilon i0/\exp\{(t/\tau R)^{2/3}\},$$

$$\tau R=\tau 0\cdot\exp(Q/RT),$$

$$\tau 0=8.46\times10^{-9},$$

$$Q=183200\text{ J},$$

$$R=8.314\text{ J/K}\cdot\text{mol},$$

εi0 represents a logarithmic strain at a reduction time, t represents a cumulative time period till immediately before the cooling in the pass, and T represents a rolling temperature in the pass.

When a finishing temperature of the rolling is set to less than $Ar_3$° C., the dislocation density of the austenite before transformation increases excessively, to thus make it difficult to set the crystal grains each having an intragranular misorientation of 5 to 14° to 20% or more. Therefore, the finishing temperature of the finish rolling is set to $Ar_3$° C. or more.

The finish rolling is preferably performed by using a tandem rolling mill in which a plurality of rolling mills are linearly arranged and that performs rolling continuously in one direction to obtain a desired thickness. Further, in the case where the finish rolling is performed using the tandem rolling mill, cooling (inter-stand cooling) is performed between the rolling mills to control the steel sheet temperature during the finish rolling to fall within a range of $Ar_3$° C. or more to $Ar_3$+150° C. or less. When the maximum temperature of the steel sheet during the finish rolling exceeds $Ar_3$+150° C., the grain size becomes too large, and thus deterioration in toughness is concerned. Further, when the maximum temperature of the steel sheet during the finish rolling exceeds $Ar_3$+150° C., γ grains grow to be coarse by the time the cooling starts after the finish rolling is finished and the grain boundary number densities of the solid-solution B and the solid-solution C at the grain boundaries increase.

The hot rolling is performed under such conditions as above, thereby making it possible to limit the dislocation density range of the austenite before transformation and obtain a desired proportion of the crystal grains each having an intragranular misorientation of 5 to 14°.

$Ar_3$ is calculated by Expression (3) below considering the effect on the transformation point by reduction based on the chemical composition of the steel sheet.

$$Ar_3=970-325\times[C]+33\times[Si]-+287\times[P]+\times[Al]-92\times([Mn]+[Mo]+[Cu])-46\times([Cr]+[Ni]) \tag{3}$$

Here, [C], [Si], [P], [Al], [Mn], [Mo], [Cu], [Cr], and [Ni] represent the contents of C, Si, P, Al, Mn, Mo, Cu, Cr, and Ni in mass % respectively. The elements that are not contained are calculated as 0%.

When the reduction ratio in the final pass in the finish rolling is less than 3%, the threading shape deteriorates, and thus there is a concern that the coiled shape of a coil when a hot coil is formed and the product sheet thickness accuracy are adversely affected. On the other hand, when the reduction ratio in the final pass in the finish rolling exceeds 20%, the dislocation density in the interior of the steel sheet increases more than necessary because strain is introduced excessively. After the finish rolling is finished, regions having a high dislocation density have high strain energy, and thus are formed into a ferrite structure easily. The ferrite formed by such transformation precipitates while not solid-dissolving carbon very much, and thus the carbon contained in a parent phase easily concentrates at the interface between austenite and ferrite, the grain boundary number density of the solid-solution C at the grain boundaries increases additionally, and coarse carbides of Nb and Ti become likely to precipitate at the interface. In the case where solid-solution N and solid-solution Ti decrease in the finish rolling in this manner, the strength improvement of the steel sheet cannot be expected and the "peeling" becomes likely to occur due to the above-described reasons. Thus, the reduction ratio in the final pass in the finish rolling is controlled to fall within a range of 3% or more and 20% or less.

When a rolling speed in the final pass in the finish rolling is less than 400 mpm, γ grains grow to be coarse and the grain boundary number density of the solid-solution C at the grain boundaries increases. Therefore, the rolling speed in the final pass in the finish rolling is set to 400 mpm or more. On the other hand, the effects of the present invention are exhibited without limiting the upper limit value of the rolling speed in particular, but it is practical that the upper limit value is 1800 mpm or less due to facility restriction. Therefore, the rolling speed in the final pass in the finish rolling is set to 1800 mpm or less.

"Air Cooling"

In this manufacturing method, air cooling of the hot-rolled steel sheet is performed only for a time period of 2 seconds or less after the finish rolling is finished. When this air cooling time period is greater than 2 seconds, the grain boundary number densities of the solid-solution B and the solid-solution C at the grain boundaries increase. Thus, this air cooling time period is set to 2 seconds or less.

"First Cooling, Second Cooling"

After the air cooling for 2 seconds or less, the first cooling and the second cooling of the hot-rolled steel sheet are performed in this order. In the first cooling, the hot-rolled steel sheet is cooled down to a first temperature zone of 600 to 750° C. at a cooling rate of 10° C./s or more. In the second cooling, the hot-rolled steel sheet is cooled down to a second temperature zone of 450 to 600° C. at a cooling rate of 30° C./s or more. Between the first cooling and the second cooling, the hot-rolled steel sheet is retained in the first temperature zone for 0 to 10 seconds. After the second cooling, the hot-rolled steel sheet is preferably air-cooled.

When the cooling rate of the first cooling is less than 10° C./s, the proportion of the crystal grains each having an intragranular crystal misorientation of 5 to 14° becomes short. Further, when a cooling stop temperature of the first cooling is less than 600° C., it becomes difficult to obtain 5% or more of ferrite by area ratio, and at the same time, the proportion of the crystal grains each having an intragranular crystal misorientation of 5 to 14° becomes short. Further, when the cooling stop temperature of the first cooling is greater than 750° C., it becomes difficult to obtain 70% or more of bainite by area ratio, and at the same time, the proportion of the crystal grains each having an intragranular crystal misorientation of 5 to 14° becomes short. Further, When the retention time at 600 to 750° C. exceeds 10 seconds, cementite harmful to the burring property is likely to be generated, and the average grain size of the cementite precipitated at the grain boundaries often exceeds 2 μm. Further, when the retention time at 600 to 750° C., exceeds 10 seconds, it is often difficult to obtain 70% or more of bainite by area ratio, and further, the proportion of the crystal grains each having an intragranular crystal misorientation of 5 to 14° becomes short.

When the cooling rate of the second cooling is less than 30° C./s, cementite harmful to the burring property is likely to be generated, and at the same time, the proportion of the crystal grains each having an intragranular crystal misorientation of 5 to 14° becomes short. When a cooling stop temperature of the second cooling is less than 400° C. or greater than 600° C., the proportion of the crystal grains each having an intragranular misorientation of 5 to 14° becomes short.

When the coiling temperature exceeds 600° C., the grain boundary number density of the solid-solution C becomes less than 1 piece/nm$^2$ and fracture surface cracking occurs. Further, the area ratio of ferrite also increases. Therefore, the coiling temperature is set to 600° C., or less and preferably set to 550° C., or less. On the other hand, when the coiling temperature is less than 400° C., the average grain size of the cementite precipitated at the grain boundaries exceeds 2 μm, and thus a hole expansion value deteriorates. Therefore, the coiling temperature is set to 400° C. or more and preferably set to 450° C. or more.

The upper limit of the cooling rate in each of the first cooling and the second cooling is not limited, in particular, but may be set to 200° C./s or less in consideration of the facility capacity of a cooling facility.

In this manner, it is possible to obtain the steel sheet according to this embodiment.

In the above-described manufacturing method, the hot rolling conditions are controlled, to thereby introduce work dislocations into the austenite. Then, it is important to make the introduced work dislocations remain moderately by controlling the cooling conditions. That is, even when the hot rolling conditions or the cooling conditions are controlled independently, it is impossible to obtain the steel sheet according to this embodiment, resulting in that it is important to appropriately control both of the hot rolling conditions and the cooling conditions. The conditions other than the above are not limited in particular because well-known methods such as coiling by a well-known method after the second cooling, for example, only need to be used.

Pickling may be performed in order to remove scales on the surface. As long as the hot rolling and cooling conditions are as above, it is possible to obtain the similar effects even when cold rolling, a heat treatment (annealing), plating, and so on are performed thereafter.

In the cold rolling, a reduction ratio is preferably set to 90% or less. When the reduction ratio in the cold rolling exceeds 90%, the ductility sometimes decreases. The cold rolling does not have to be performed and the lower limit of the reduction ratio in the cold rolling is 0%. As above, an intact hot-rolled original sheet has excellent formability. On the other hand, on dislocations introduced by the cold rolling, solid-dissolved Ti, Nb, Mo, and so on collect to precipitate, thereby making it possible to improve a yield strength and a tensile strength. Thus, the cold rolling can be used for adjusting the strength. A cold-rolled steel sheet is obtained by the cold rolling.

When the temperature of the heat treatment (annealing) exceeds 840° C., the structure formed by the hot rolling is austenitized to be canceled. Further, generally, cooling down to room temperature is performed for a short time as compared to the hot rolling after the annealing, and thus martensite increases and the stretch flangeability tends to deteriorate greatly. Therefore, the annealing temperature is preferably set to 840° C. or less. The lower limit of the annealing temperature is not set in particular. As described above, this is because the intact hot-rolled original sheet that is not subjected to annealing has excellent formability.

On the surface of the steel sheet in this embodiment, a plating layer may be formed. That is, a plated steel sheet can be cited as another embodiment of the present invention. The plating layer is, for example, an electroplating layer, a hot-dip plating layer, or an alloyed hot-dip plating layer. As the hot-dip plating layer and the alloyed hot-dip plating layer, a layer made of at least one of zinc and aluminum, for example, can be cited. Concretely, there can be cited a hot-dip galvanizing layer, an alloyed hot-dip galvanizing layer, a hot-dip aluminum plating layer, an alloyed hot-dip aluminum plating layer, a hot-dip Zn—Al plating layer, an alloyed hot-dip Zn—Al plating layer, and so on. From the viewpoints of platability and corrosion resistance, in particular, the hot-dip galvanizing layer and the alloyed hot-dip galvanizing layer are preferable.

A hot-dip plated steel sheet and an alloyed hot-dip plated steel sheet are manufactured by performing hot dipping or alloying hot dipping on the aforementioned steel sheet according to this embodiment. Here, the alloying hot dipping means that hot dipping is performed to form a hot-dip plating layer on a surface, and then an alloying treatment is performed thereon to form the hot-dip plating layer into an alloyed hot-dip plating layer. The steel sheet that is subjected to plating may be the hot-rolled steel sheet, or a steel sheet obtained after the cold rolling and the annealing are performed on the hot-rolled steel sheet. The hot-dip plated steel sheet and the alloyed hot-dip plated steel sheet include the steel sheet according to this embodiment and have the hot-dip plating layer and the alloyed hot-dip plating layer provided thereon respectively, and thereby, it is possible to achieve an excellent rust prevention property together with the functional effects of the steel sheet according to this embodiment. Before performing plating, Ni or the like may be applied to the surface as pre-plating.

When the heat treatment (annealing) is performed on the steel sheet, the steel sheet may be immersed in a hot-dip galvanizing bath directly after being subjected to the heat treatment to form the hot-dip galvanizing layer on the surface thereof. In this case, the original sheet for the heat treatment may be the hot-rolled steel sheet or the cold-rolled steel sheet. After the hot-dip galvanizing layer is formed, the alloyed hot-dip galvanizing layer may be formed by reheating the steel sheet and performing the alloying treatment to alloy the galvanizing layer and the base iron.

The plated steel sheet according to the embodiment of the present invention has an excellent rust prevention property because the plating layer is formed on the surface of the steel sheet. Thus, when an automotive member is reduced in thickness by using the plated steel sheet in this embodiment, for example, it is possible to prevent shortening of the usable life of an automobile that is caused by corrosion of the member.

Note that the above-described embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

Examples

Next, examples of the present invention will be explained. Conditions in the examples are examples of conditions employed to verify feasibility and effects of the present invention, and the present invention is not limited to the examples of conditions. The present invention can employ various conditions without departing from the spirit of the present invention to the extent to achieve the objects of the present invention.

Steels having chemical compositions illustrated in Table 1 were smelted to manufacture steel billets, the obtained steel billets were heated to heating temperatures illustrated in Table 2 and Table 3 to be subjected to rough rolling in hot working, and then subjected to finish rolling under conditions illustrated in Table 2 and Table 3. Sheet thicknesses of hot-rolled steel sheets after the rolling were 2.2 to 3.4 mm. "ELAPSED TIME" in Table 2 and Table 3 is the elapsed time between finish of the rough rolling and start of the finish rolling. Each blank column in Table 1 indicates that an analysis value was less than a detection limit. Each underline in Table 1 indicates that a numerical value thereof is out of the range of the present invention, and each underline in Table 3 indicates that a numerical value thereof is out of the range suitable for the manufacture of the steel sheet of the present invention.

TABLE 1

| STEEL | CHEMICAL COMPOSITION (MASS %, BALANCE: Fe AND IMPURITIES) | | | | | | | | | | | |
|---|---|---|---|---|---|---|---|---|---|---|---|---|
| No. | C | Si | Mn | P | S | Al | Ti | Nb | N | Cr | B | Mo |
| A | 0.047 | 0.41 | 0.72 | 0.011 | 0.005 | 0.050 | 0.150 | 0.031 | 0.0026 | | | |
| B | 0.036 | 0.32 | 1.02 | 0.019 | 0.003 | 0.030 | 0.090 | 0.022 | 0.0019 | | | |
| C | 0.070 | 1.22 | 1.21 | 0.022 | 0.006 | 0.040 | 0.110 | 0.042 | 0.0034 | | | |
| D | 0.053 | 0.81 | 1.51 | 0.016 | 0.012 | 0.030 | 0.110 | 0.033 | 0.0027 | 0.15 | | |
| E | 0.039 | 0.21 | 1.01 | 0.014 | 0.008 | 0.040 | 0.040 | 0.022 | 0.0029 | | | |
| F | 0.041 | 0.93 | 1.23 | 0.014 | 0.010 | 0.030 | 0.150 | 0.037 | 0.0034 | | | |
| G | 0.064 | 0.72 | 1.21 | 0.014 | 0.009 | 0.100 | 0.120 | 0.031 | 0.0043 | | 0.0010 | |
| H | 0.051 | 0.53 | 1.33 | 0.016 | 0.008 | 0.030 | 0.140 | 0.041 | 0.0027 | | | |
| I | 0.059 | 0.62 | 1.02 | 0.010 | 0.010 | 0.080 | 0.110 | 0.023 | 0.0021 | | | |
| J | 0.031 | 0.62 | 0.73 | 0.013 | 0.006 | 0.030 | 0.110 | 0.022 | 0.0027 | | | |
| K | 0.043 | 1.42 | 1.72 | 0.011 | 0.003 | 0.050 | 0.150 | 0.032 | 0.0035 | | | 0.13 |
| L | 0.054 | 0.43 | 1.52 | 0.014 | 0.005 | 0.040 | 0.130 | 0.041 | 0.002 | | | |
| M | 0.056 | 0.22 | 1.23 | 0.016 | 0.008 | 0.030 | 0.160 | 0.021 | 0.001 | | | |
| N | 0.066 | 0.81 | 1.41 | 0.015 | 0.007 | 0.050 | 0.090 | 0.017 | 0.002 | | | |
| O | 0.061 | 0.61 | 1.62 | 0.018 | 0.009 | 0.040 | 0.120 | 0.023 | 0.003 | | | |
| P | 0.052 | 0.81 | 1.82 | 0.015 | 0.010 | 0.030 | 0.100 | 0.033 | 0.003 | | | |
| Q | 0.039 | 0.13 | 1.41 | 0.010 | 0.008 | 0.200 | 0.070 | 0.012 | 0.003 | | | |
| R | 0.026 | 0.05 | 1.16 | 0.011 | 0.004 | 0.015 | 0.070 | 0.000 | 0.003 | | | |
| S | 0.092 | 0.05 | 1.20 | 0.002 | 0.003 | 0.030 | 0.015 | 0.029 | 0.003 | | | |
| T | 0.062 | 0.06 | 1.48 | 0.017 | 0.003 | 0.035 | 0.055 | 0.035 | 0.003 | | | |
| U | 0.081 | 0.04 | 1.52 | 0.014 | 0.004 | 0.030 | 0.022 | 0.020 | 0.003 | | | |
| a | 0.162 | 0.42 | 1.22 | 0.010 | 0.006 | 0.300 | 0.080 | 0.043 | 0.002 | | | |
| b | 0.051 | 2.73 | 0.82 | 0.012 | 0.010 | 0.050 | 0.090 | 0.032 | 0.002 | | | |
| c | 0.047 | 0.23 | 3.21 | 0.015 | 0.008 | 0.040 | 0.080 | 0.041 | 0.003 | | | |
| d | 0.039 | 0.52 | 0.82 | 0.013 | 0.007 | 0.030 | 0.050 | 0.002 | 0.004 | | 0.0030 | |
| e | 0.064 | 0.62 | 1.72 | 0.016 | 0.012 | 0.030 | 0.250 | 0.032 | 0.002 | | | |
| g | 0.049 | 0.52 | 1.22 | 0.018 | 0.009 | 0.060 | 0.150 | 0.081 | 0.003 | | | |

| STEEL | CHEMICAL COMPOSITION (MASS %, BALANCE: Fe AND IMPURITIES) | | | | | | | $Ar_3$ |
|---|---|---|---|---|---|---|---|---|
| No. | Cu | Ni | Mg | REM | Ca | Zr | Ti + Nb | (° C.) |
| A | | | | | | | 0.181 | 907 |
| B | | | | | | | 0.112 | 882 |
| C | | | | | 0.001 | | 0.152 | 884 |
| D | | | | | | | 0.143 | 839 |
| E | | | | | | | 0.062 | 870 |
| F | | | | | | | 0.187 | 880 |
| G | | | | | | | 0.151 | 870 |

TABLE 1-continued

| | | | | | | | | |
|---|---|---|---|---|---|---|---|---|
| H | | | | | | | 0.181 | 855 |
| I | 0.06 | 0.03 | | | | 0 | 0.133 | 877 |
| J | | | | | | | 0.132 | 918 |
| K | | | | | | | 0.182 | 838 |
| L | | | | 0.005 | | | 0.171 | 832 |
| M | 0.08 | 0.04 | | | | | 0.181 | 842 |
| N | | | | | | | 0.107 | 852 |
| O | | | 0.0003 | | | | 0.143 | 828 |
| P | | | | | | | 0.133 | 818 |
| Q | | | | | | | 0.082 | 843 |
| R | | | | | | | 0.070 | 860 |
| S | | | | | | | 0.044 | 833 |
| T | | | | | | | 0.090 | 822 |
| U | | | | | | | 0.042 | 811 |
| a | | | | | | | 0.123 | 834 |
| b | | | | | 6E−04 | | 0.122 | 974 |
| c | | | | | | | 0.121 | 673 |
| d | | | | | | | 0.007 | 904 |
| e | | | | | | | 0.282 | 817 |
| g | | | | | | | 0.231 | 867 |

TABLE 2

| TEST No. | STEEL No. | $Ar_3$ (° C.) | SRTmin (° C.) | HEATING TEMPERATURE (° C.) | ROUGH ROLLING FINISHING TEMPERATURE (° C.) | ELAPSED TIME (SECOND) | FINISH ROLLING FINISHING TEMPERATURE (° C.) | CUMULATIVE STRAIN AT FINAL THREE STAGES OF FINISH ROLLING |
|---|---|---|---|---|---|---|---|---|
| 1 | A | 907 | 1141 | 1200 | 1059 | 80 | 913 | 0.55 |
| 2 | B | 882 | 1071 | 1180 | 1089 | 50 | 900 | 0.58 |
| 3 | C | 884 | 1179 | 1220 | 1097 | 60 | 902 | 0.56 |
| 4 | D | 839 | 1139 | 1200 | 1090 | 70 | 880 | 0.55 |
| 5 | E | 870 | 1037 | 1180 | 1072 | 60 | 900 | 0.52 |
| 6 | F | 880 | 1135 | 1200 | 1061 | 60 | 920 | 0.53 |
| 7 | G | 870 | 1162 | 1180 | 1063 | 90 | 892 | 0.54 |
| 8 | H | 855 | 1158 | 1230 | 1074 | 50 | 910 | 0.59 |
| 9 | I | 877 | 1134 | 1210 | 1097 | 60 | 893 | 0.56 |
| 10 | J | 918 | 1067 | 1230 | 1088 | 50 | 930 | 0.57 |
| 11 | K | 838 | 1135 | 1200 | 1099 | 70 | 889 | 0.51 |
| 12 | L | 832 | 1161 | 1200 | 1075 | 80 | 920 | 0.56 |
| 13 | M | 842 | 1149 | 1230 | 1059 | 80 | 902 | 0.54 |
| 14 | N | 852 | 1120 | 1180 | 1070 | 90 | 880 | 0.53 |
| 15 | O | 828 | 1143 | 1200 | 1093 | 50 | 889 | 0.58 |
| 16 | P | 818 | 1131 | 1180 | 1055 | 50 | 870 | 0.58 |
| 17 | Q | 843 | 1041 | 1200 | 1063 | 70 | 908 | 0.59 |
| 18 | R | 860 | 1000 | 1240 | 1054 | 70 | 920 | 0.54 |
| 19 | S | 833 | 1079 | 1240 | 1075 | 50 | 910 | 0.53 |
| 20 | T | 822 | 1117 | 1240 | 1050 | 50 | 940 | 0.58 |
| 21 | U | 811 | 1069 | 1240 | 1069 | 70 | 910 | 0.58 |

| TEST No. | MAXIMUM TEMPERATURE OF STEEL SHEET AT FINISH ROLLING TIME (° C.) | REDUCTION RATIO IN FINAL PASS OF FINISH ROLLING (%) | ROLLING SPEED AT FINISH ROLLING TIME (mpm) | AIR COOLING TIME PERIOD (SECOND) | COOLING RATE OF FIRST COOLING (° C./s) | COOLING STOP TEMPERATURE OF FIRST COOLING (° C.) |
|---|---|---|---|---|---|---|
| 1 | 1030 | 14 | 800 | 2 | 15 | 690 |
| 2 | 1010 | 13 | 700 | 1.8 | 20 | 650 |
| 3 | 1000 | 13 | 900 | 1.7 | 30 | 610 |
| 4 | 980 | 14 | 600 | 1.8 | 35 | 830 |
| 5 | 1000 | 16 | 800 | 1.5 | 30 | 650 |
| 6 | 1020 | 13 | 700 | 1.8 | 20 | 630 |
| 7 | 990 | 10 | 700 | 1.5 | 35 | 660 |
| 8 | 1000 | 16 | 800 | 1.8 | 20 | 670 |
| 9 | 1005 | 15 | 600 | 1.6 | 40 | 630 |
| 10 | 1020 | 12 | 700 | 1.6 | 27 | 680 |
| 11 | 970 | 12 | 900 | 2.2 | 16 | 690 |
| 12 | 970 | 10 | 900 | 1.5 | 55 | 650 |
| 13 | 970 | 13 | 900 | 1.5 | 48 | 640 |
| 14 | 980 | 13 | 900 | 1.9 | 45 | 650 |
| 15 | 970 | 15 | 600 | 1.6 | 40 | 660 |
| 16 | 960 | 13 | 800 | 2 | 15 | 630 |
| 17 | 987 | 13 | 700 | 1.6 | 23 | 680 |
| 18 | 960 | 16 | 800 | 2.2 | 49 | 660 |

TABLE 2-continued

| | | | | | | |
|---|---|---|---|---|---|---|
| 19 | 930 | 11 | 900 | 1.8 | 50 | 660 |
| 20 | 950 | 11 | 800 | 2.2 | 50 | 620 |
| 21 | 950 | 15 | 900 | 2.2 | 60 | 610 |

| TEST No. | RETENTION TIME IN FIRST TEMPERATURE ZONE (SECOND) | COOLING RATE OF SECOND COOLING (° C./s) | COOLING STOP TEMPERATURE OF SECOND COOLING (° C.) | COLD ROLLING | HEAT TREATMENT TEMPERATURE (° C.) | PLATING |
|---|---|---|---|---|---|---|
| 1 | 0.3 | 75 | 550 | NONE | NONE | NONE |
| 2 | 2 | 64 | 550 | NONE | NONE | NONE |
| 3 | 1 | 62 | 540 | NONE | NONE | NONE |
| 4 | 2.5 | 65 | 550 | NONE | NONE | NONE |
| 5 | 1.2 | 63 | 560 | NONE | NONE | NONE |
| 6 | 2 | 64 | 530 | NONE | NONE | NONE |
| 7 | 3 | 66 | 510 | NONE | NONE | NONE |
| 8 | 1.2 | 63 | 570 | NONE | NONE | NONE |
| 9 | 1 | 62 | 520 | NONE | NONE | NONE |
| 10 | 2 | 64 | 500 | NONE | NONE | NONE |
| 11 | 4 | 68 | 540 | NONE | NONE | NONE |
| 12 | 1 | 63 | 530 | NONE | NONE | NONE |
| 13 | 1 | 62 | 540 | NONE | NONE | NONE |
| 14 | 2 | 64 | 530 | NONE | NONE | NONE |
| 15 | 3 | 66 | 540 | NONE | NONE | NONE |
| 16 | 4 | 65 | 570 | NONE | NONE | NONE |
| 17 | 4 | 65 | 500 | NONE | NONE | NONE |
| 18 | 3 | 63 | 500 | NONE | 700 | GI |
| 19 | 1 | 63 | 550 | NONE | 700 | GI |
| 20 | 2 | 63 | 540 | NONE | 700 | GI |
| 21 | 2 | 63 | 550 | 62% | 750 | GA |

TABLE 3

| TEST No. | STEEL No. | $Ar_3$ (° C.) | SRTmin (° C.) | HEATING TEMPERATURE (° C.) | ROUGH ROLLING FINISHING TEMPERATURE (° C.) | ELAPSED TIME (SECOND) | FINISH ROLLING FINISHING TEMPERATURE (° C.) | CUMULATIVE STRAIN AT FINAL THREE STAGES OF FINISH ROLLING |
|---|---|---|---|---|---|---|---|---|
| 22 | a | 834 | 1257 | 1210 | 1093 | 60 | 890 | 0.55 |
| 23 | b | 974 | 1120 | 1180 | 1098 | 70 | 982 | 0.56 |
| 24 | c | 673 | 1116 | 1200 | 1082 | 60 | 760 | 0.57 |
| 25 | d | 904 | 962 | 1200 | 1099 | 60 | 908 | 0.55 |
| 26 | e | 817 | 1212 | 1270 | 1057 | 50 | 870 | 0.54 |
| 27 | g | 867 | 1191 | 1210 | 1082 | 60 | 900 | 0.55 |
| 28 | M | 842 | 1149 | 1130 | 1092 | 90 | 900 | 0.54 |
| 29 | C | 884 | 1179 | 1180 | 1084 | 60 | 1060 | 0.52 |
| 30 | C | 884 | 1179 | 1180 | 1051 | 80 | 850 | 0.52 |
| 31 | C | 884 | 1179 | 1200 | 1072 | 70 | 892 | 0.44 |
| 32 | C | 884 | 1179 | 1200 | 1078 | 50 | 903 | 0.69 |
| 33 | C | 884 | 1179 | 1210 | 1095 | 50 | 950 | 0.58 |
| 34 | C | 884 | 1179 | 1200 | 1100 | 50 | 902 | 0.59 |
| 35 | C | 884 | 1179 | 1190 | 1093 | 50 | 920 | 0.56 |
| 36 | M | 842 | 1149 | 1200 | 1086 | 60 | 900 | 0.53 |
| 37 | M | 842 | 1149 | 1180 | 1057 | 70 | 889 | 0.54 |
| 38 | M | 842 | 1149 | 1200 | 1067 | 60 | 890 | 0.55 |
| 39 | M | 842 | 1149 | 1200 | 1067 | 80 | 895 | 0.56 |
| 40 | M | 842 | 1149 | 1210 | 1057 | 70 | 902 | 0.57 |
| 41 | M | 842 | 1149 | 1210 | 1073 | 50 | 900 | 0.52 |
| 42 | M | 842 | 1149 | 1230 | 1190 | 90 | 902 | 0.54 |
| 43 | M | 842 | 1149 | 1230 | 1050 | 250 | 902 | 0.54 |
| 44 | M | 842 | 1149 | 1230 | 1092 | 90 | 902 | 0.54 |
| 45 | M | 842 | 1149 | 1230 | 1084 | 50 | 902 | 0.54 |
| 46 | M | 842 | 1149 | 1230 | 1073 | 50 | 902 | 0.54 |
| 47 | M | 842 | 1149 | 1210 | 1094 | 60 | 900 | 0.52 |

TABLE 3-continued

| TEST No. | MAXIMUM TEMPERATURE OF STEEL SHEET AT FINISH ROLLING TIME (° C.) | REDUCTION RATIO IN FINAL PASS OF FINISH ROLLING (%) | ROLLING SPEED AT FINISH ROLLING TIME (mpm) | AIR COOLING TIME PERIOD (SECOND) | COOLING RATE OF FIRST COOLING (° C./s) | COOLING STOP TEMPERATURE OF FIRST COOLING (° C.) |
|---|---|---|---|---|---|---|
| 22 | 990 | 16 | 600 | 1.7 | 30 | 690 |
| 23 | 1079 | 11 | 700 | 1.8 | 25 | 690 |
| 24 | 820 | 12 | 800 | 2 | 43 | 700 |
| 25 | 990 | 16 | 700 | 1.7 | 18 | 670 |
| 26 | 960 | 16 | 800 | 2.2 | 32 | 640 |
| 27 | 980 | 15 | 600 | 1.7 | 45 | 710 |
| 28 | 980 | 11 | 700 | 2.1 | 30 | 690 |
| 29 | 1010 | 12 | 900 | 1.5 | 15 | 740 |
| 30 | 1010 | 12 | 900 | 2.1 | 15 | 740 |
| 31 | 1010 | 16 | 800 | 2 | 24 | 720 |
| 32 | 1010 | 11 | 800 | 1.9 | 43 | 710 |
| 33 | 1050 | 15 | 600 | 2 | 35 | 720 |
| 34 | 1010 | 10 | 900 | 1.9 | 3 | 680 |
| 35 | 1010 | 16 | 600 | 1.8 | 23 | 530 |
| 36 | 990 | 14 | 700 | 1.8 | 45 | 705 |
| 37 | 980 | 12 | 900 | 1.6 | 20 | 710 |
| 38 | 990 | 10 | 700 | 2 | 12 | 650 |
| 39 | 985 | 13 | 600 | 1.8 | 12 | 700 |
| 40 | 990 | 12 | 900 | 1.9 | 32 | 600 |
| 41 | 980 | 13 | 900 | 1.9 | 29 | 700 |
| 42 | 970 | 11 | 900 | 1.5 | 48 | 700 |
| 43 | 970 | 11 | 800 | 2.2 | 48 | 680 |
| 44 | 970 | 25 | 800 | 1.7 | 48 | 670 |
| 45 | 970 | 12 | 250 | 2.2 | 48 | 710 |
| 46 | 970 | 10 | 600 | 20 | 48 | 710 |
| 47 | 980 | 15 | 600 | 2.1 | 30 | 730 |

| TEST No. | RETENTION TIME IN FIRST TEMPERATURE ZONE (SECOND) | COOLING RATE OF SECOND COOLING (° C./s) | COOLING STOP TEMPERATURE OF SECOND COOLING (° C.) | COLD ROLLING | HEAT TREATMENT TEMPERATURE (° C.) | PLATING |
|---|---|---|---|---|---|---|
| 22 | 1 | 64 | 550 | NONE | NONE | NONE |
| 23 | 2 | 65 | 570 | NONE | NONE | NONE |
| 24 | 5 | 66 | 560 | NONE | NONE | NONE |
| 25 | 2 | 62 | 550 | NONE | NONE | NONE |
| 26 | 3 | 63 | 540 | NONE | NONE | NONE |
| 27 | 4 | 64 | 520 | NONE | NONE | NONE |
| 28 | 4 | 64 | 560 | NONE | NONE | NONE |
| 29 | 3 | 63 | 570 | NONE | NONE | NONE |
| 30 | 3 | 63 | 570 | NONE | NONE | NONE |
| 31 | 6 | 66 | 560 | NONE | NONE | NONE |
| 32 | 3 | 63 | 540 | NONE | NONE | NONE |
| 33 | 3 | 63 | 540 | NONE | NONE | NONE |
| 34 | 6 | 66 | 530 | NONE | NONE | NONE |
| 35 | 4 | 64 | 530 | NONE | NONE | NONE |
| 36 | 5 | 65 | 530 | NONE | NONE | NONE |
| 37 | 0 | 60 | 320 | NONE | NONE | NONE |
| 38 | 25 | 75 | 550 | NONE | NONE | NONE |
| 39 | 4 | 5 | 570 | NONE | NONE | NONE |
| 40 | 4 | 65 | 360 | NONE | NONE | NONE |
| 41 | 1 | 63 | 670 | NONE | NONE | NONE |
| 42 | 2 | 62 | 550 | NONE | NONE | NONE |
| 43 | 2 | 62 | 550 | NONE | NONE | NONE |
| 44 | 2 | 62 | 550 | NONE | NONE | NONE |
| 45 | 2 | 62 | 550 | NONE | NONE | NONE |
| 46 | 2 | 62 | 550 | NONE | NONE | NONE |
| 47 | 3 | 63 | 550 | NONE | 900 | NONE |

$Ar_3$ (° C.) was obtained from the components illustrated in Table 1 by using Expression (3).

$$Ar_3=970-325\times[C]+33\times[Si]+287\times[P]+\times[Al]-92\times([Mn]+[Mo]+[Cu])-46\times([Cr]+[Ni]) \quad (3)$$

The cumulative strain at the final three stages was obtained by Expression (2)

$$\varepsilon eff.=\Sigma\varepsilon i(t,T) \quad (2)$$

Here, $$\varepsilon i(t,T)=\varepsilon i0/\exp\{(t/\tau R)^{2/3}\},$$

$$\tau R=\tau 0\cdot\exp(Q/RT),$$

$$\tau 0=8.46\times10^{-9},$$

$$Q=183200\ J,$$

$$R=8.314\ J/K\cdot mol,$$

εi0 represents a logarithmic strain at a reduction time, t represents a cumulative time period till immediately before the cooling in the pass, and T represents a rolling temperature in the pass.

Of the obtained hot-rolled steel sheets, structural fractions (area ratios) of respective structures and a proportion of crystal grains each having an intragranular misorientation of 5 to 14° were obtained by the following methods. Results thereof are illustrated in Table 4 and Table 5. Each underline in Table 5 indicates that a numerical value thereof is out of the range of the present invention.

"Structural Fractions (Area Ratios) of Respective Structures"

First, a sample collected from the steel sheet was etched by nital. After the etching, a structure photograph obtained at a ¼ depth position of the sheet thickness in a visual field of 300 μm×300 μm was subjected to an image analysis by using an optical microscope. By this image analysis, the area ratio of ferrite, the area ratio of pearlite, and the total area ratio of bainite and martensite were obtained. Next, a sample etched by LePera was used, and a structure photograph obtained at a ¼ depth position of the sheet thickness in a visual field of 300 μm×300 μm was subjected to an image analysis by using an optical microscope. By this image analysis, the total area ratio of retained austenite and martensite was obtained. Further, a sample obtained by grinding the surface to a depth of ¼ of the sheet thickness from a direction normal to a rolled surface was used, and the volume fraction of the retained austenite was obtained through an X-ray diffraction measurement. The volume fraction of the retained austenite was equivalent to the area ratio, and thus was set as the area ratio of the retained austenite. Then, the area ratio of martensite was obtained by subtracting the area ratio of the retained austenite from the total area ratio of the retained austenite and the martensite, and the area ratio of bainite was obtained by subtracting the area ratio of the martensite from the total area ratio of the bainite and the martensite. In this manner, the area ratio of each of ferrite, bainite, martensite, retained austenite, and pearlite was obtained.

"Proportion of Crystal Grains Each Having an Intragranular Misorientation of 5 to 14°"

At a ¼ depth position of a sheet thickness t from the surface of the steel sheet (¼ t portion) in a cross section vertical to a rolling direction, a region of 200 μm in the rolling direction and 100 μm in a direction normal to the rolled surface was subjected to an EBSD analysis at a measurement pitch of 0.2 μm to obtain crystal orientation information. Here, the EBSD analysis was performed by using an apparatus composed of a thermal field emission scanning electron microscope (JSM-7001F manufactured by JEOL Ltd.) and an EBSD detector (HIKARI detector manufactured by TSL Co., Ltd.), at an analysis speed of 200 to 300 points/second. Next, with respect to the obtained crystal orientation information, a region having a misorientation of 15° or more and a circle-equivalent diameter of 0.3 μm or more was defined as a crystal grain, the average intragranular misorientation of crystal grains was calculated, and the proportion of the crystal grains each having an intragranular misorientation of 5 to 14° was obtained. The crystal grain defined as described above and the average intragranular misorientation were calculated by using software "OIM Analysis (registered trademark)" attached to an EBSD analyzer.

Next, in a tensile test, a yield strength and a tensile strength were obtained, and by a saddle-type stretch-flange test, a limit form height of a flange was obtained. Then, the product of the tensile strength (MPa) and the limit form height (mm) was set as an index of the stretch flangeability, and the case of the product being 19500 mm·MPa or more was judged to be excellent in stretch flangeability. Further, the case of the tensile strength (TS) being 480 MPa or more was judged to be high in strength. Results thereof are illustrated in Table 4 and Table 5. Each underline in Table 5 indicates that a numerical value thereof is out of the range of the present invention.

As for the tensile test, a JIS No. 5 tensile test piece was collected from a direction right angle to the rolling direction, and this test piece was used to perform the test according to JISZ2241.

The saddle-type stretch-flange test was performed by using a saddle-type formed product in which a radius of curvature R of a corner is set to 60 mm and an opening angle θ is set to 120° and setting a clearance at the time of punching the corner portion to 11%. The limit form height was set to a limit form height with no existence of cracks by visually observing whether or not a crack having a length of ⅓ or more of the sheet thickness exists after forming.

In order to examine the degree of peeling, punching of the steel sheet was performed to observe its end face. As for the punching condition, the above was performed according to a hole expansion test (JFS T 1001-1996). The steel sheet was punched at 10 places, and one having two or less fracture surface crackings was judged to be OK and one having three or more fracture surface crackings was judged to be NG. The average grain size of cementite precipitated at grain boundaries and the grain boundary number density of solid-solution C or the grain boundary number density of the total of solid-solution C and solid-solution B were observed by the above-described methods. Results thereof are illustrated in Table 4 and Table 5. Each underline in Table 5 indicates that a numerical value thereof is out of the range of the present invention.

TABLE 4

| TEST No. | FERRITE AREA RATIO (%) | BAINITE AREA RATIO (%) | PROPORTION OF CRYSTAL GRAINS EACH HAVING INTRAGRANULAR MISORIENTATION OF 5 TO 14° (%) | GRAIN BOUNDARY NUMBER DENSITY OF SOLID-SOLUTION C AND/OR SOLID-SOLUTION B (PIECE/nm$^2$) | AVERAGE GRAIN SIZE OF CEMENTITE PRECIPITATED AT GRAIN BOUNDARIES (μm) | FRACTURE SURFACE CRACKING JUDGMENT |
|---|---|---|---|---|---|---|
| 1 | 20 | 80 | 50 | 2.3 | 0.8 | OK |
| 2 | 14 | 86 | 70 | 2.3 | 0.3 | OK |
| 3 | 10 | 90 | 60 | 2.9 | 0.8 | OK |
| 4 | 16 | 84 | 63 | 1.6 | 0.7 | OK |
| 5 | 11 | 89 | 33 | 3.4 | 0.3 | OK |
| 6 | 14 | 86 | 42 | 3.5 | 0.3 | OK |
| 7 | 17 | 83 | 53 | 2.3 | 0.8 | OK |
| 8 | 11 | 89 | 73 | 1.6 | 0.5 | OK |
| 9 | 10 | 90 | 68 | 1.6 | 0.3 | OK |
| 10 | 14 | 86 | 71 | 2.3 | 0.7 | OK |
| 11 | 20 | 80 | 48 | 1.8 | 0.4 | OK |
| 12 | 10 | 90 | 72 | 2.8 | 0.3 | OK |
| 13 | 10 | 90 | 52 | 3.5 | 0.6 | OK |
| 14 | 14 | 86 | 56 | 3.3 | 0.3 | OK |
| 15 | 17 | 83 | 80 | 2.8 | 0.4 | OK |
| 16 | 20 | 80 | 74 | 2.0 | 0.3 | OK |
| 17 | 20 | 80 | 75 | 1.7 | 0.6 | OK |
| 18 | 17 | 83 | 70 | 2.8 | 0.4 | OK |
| 19 | 10 | 90 | 70 | 3.1 | 0.8 | OK |
| 20 | 14 | 86 | 60 | 3.5 | 0.8 | OK |
| 21 | 14 | 86 | 73 | 1.6 | 0.3 | OK |

| TEST No. | YIELD STRENGTH (MPa) | TENSILE STRENGTH (MPa) | INDEX OF STRETCH FLANGEABILITY (mm · MPa) | NOTE |
|---|---|---|---|---|
| 1 | 572 | 647 | 20384 | PRESENT INVENTION EXAMPLE |
| 2 | 562 | 594 | 22712 | PRESENT INVENTION EXAMPLE |
| 3 | 739 | 805 | 21587 | PRESENT INVENTION EXAMPLE |
| 4 | 665 | 777 | 22328 | PRESENT INVENTION EXAMPLE |
| 5 | 502 | 595 | 19774 | PRESENT INVENTION EXAMPLE |
| 6 | 691 | 790 | 19731 | PRESENT INVENTION EXAMPLE |
| 7 | 593 | 706 | 20345 | PRESENT INVENTION EXAMPLE |
| 8 | 668 | 762 | 21830 | PRESENT INVENTION EXAMPLE |
| 9 | 559 | 604 | 21981 | PRESENT INVENTION EXAMPLE |
| 10 | 537 | 632 | 21706 | PRESENT INVENTION EXAMPLE |
| 11 | 751 | 823 | 20000 | PRESENT INVENTION EXAMPLE |
| 12 | 660 | 833 | 21906 | PRESENT INVENTION EXAMPLE |
| 13 | 638 | 687 | 20866 | PRESENT INVENTION EXAMPLE |
| 14 | 565 | 651 | 21178 | PRESENT INVENTION EXAMPLE |
| 15 | 553 | 698 | 22419 | PRESENT INVENTION EXAMPLE |
| 16 | 704 | 767 | 22199 | PRESENT INVENTION EXAMPLE |
| 17 | 516 | 584 | 22010 | PRESENT INVENTION EXAMPLE |
| 18 | 528 | 580 | 21934 | PRESENT INVENTION EXAMPLE |
| 19 | 454 | 526 | 21967 | PRESENT INVENTION EXAMPLE |
| 20 | 584 | 667 | 22348 | PRESENT INVENTION EXAMPLE |
| 21 | 586 | 667 | 24651 | PRESENT INVENTION EXAMPLE |

TABLE 5

| TEST No. | FERRITE AREA RATIO (%) | BAINITE AREA RATIO (%) | PROPORTION OF CRYSTAL GRAINS EACH HAVING INTRAGRANULAR MISORIENTATION OF 5 TO 14° (%) | GRAIN BOUNDARY NUMBER DENSITY OF SOLID-SOLUTION C AND/OR SOLID-SOLUTION B (PIECE/nm$^2$) | AVERAGE GRAIN SIZE OF CEMENTITE PRECIPITATED AT GRAIN BOUNDARIES (μm) | FRACTURE SURFACE CRACKING JUDGMENT |
|---|---|---|---|---|---|---|
| 22 | 10 | 90 | 11 | 1.5 | 0.6 | OK |
| 23 | 85 | 15 | 9 | 3.5 | 0.7 | OK |
| 24 | 2 | 45 | 15 | 2.9 | 0.6 | OK |
| 25 | 28 | 72 | 27 | 2.9 | 0.5 | OK |
| 26 | CRACK OCCURRED DURING ROLLING | | | | | |
| 27 | 27 | 73 | 7 | 3.5 | 0.3 | OK |
| 28 | 25 | 75 | 18 | 3.8 | 0.7 | OK |
| 29 | 21 | 79 | 3 | 8.0 | 0.4 | OK |

TABLE 5-continued

| | | | | | | |
|---|---|---|---|---|---|---|
| 30 | 39 | 61 | 3 | 2.2 | 0.8 | OK |
| 31 | 22 | 78 | 18 | 3.3 | 0.8 | OK |
| 32 | 23 | 77 | 13 | 2.9 | 0.5 | OK |
| 33 | 27 | 73 | 8 | 2.8 | 0.7 | OK |
| 34 | 28 | 72 | 18 | 3.6 | 0.3 | OK |
| 35 | 4 | 96 | 10 | 1.6 | 0.3 | OK |
| 36 | 78 | 22 | 17 | 3.2 | 0.5 | OK |
| 37 | 2 | 98 | 18 | 2.2 | 0.6 | OK |
| 38 | 82 | 18 | 13 | 1.6 | 3.5 | OK |
| 39 | 27 | 73 | 11 | 2.2 | 2.7 | OK |
| 40 | 10 | 90 | 12 | 1.9 | 1.7 | OK |
| 41 | 88 | 12 | 10 | 0.1 | UNOBSERVABLE | NG |
| 42 | 27 | 73 | 43 | 0.3 | 0.5 | NG |
| 43 | 25 | 75 | 51 | 0.5 | 0.8 | NG |
| 44 | 36 | 64 | 50 | 6.0 | 0.3 | NG |
| 45 | 29 | 71 | 43 | 6.0 | 0.3 | NG |
| 46 | 28 | 72 | 52 | 6.3 | 0.4 | NG |
| 47 | 18 | 50 (BALANCE MARTENSITE) | 8 | 1.8 | 0.6 | OK |

| TEST No. | YIELD STRENGTH (MPa) | TENSILE STRENGTH (MPa) | INDEX OF STRETCH FLANGEABILITY (mm · MPa) | NOTE |
|---|---|---|---|---|
| 22 | 667 | 857 | 17085 | COMPARATIVE EXAMPLE |
| 23 | 612 | 632 | 17690 | COMPARATIVE EXAMPLE |
| 24 | 861 | 987 | 10007 | COMPARATIVE EXAMPLE |
| 25 | 335 | 450 | 18723 | COMPARATIVE EXAMPLE |
| 26 | CRACK OCCURRED DURING ROLLING | | | COMPARATIVE EXAMPLE |
| 27 | 881 | 886 | 7830 | COMPARATIVE EXAMPLE |
| 28 | 533 | 738 | 17243 | COMPARATIVE EXAMPLE |
| 29 | 644 | 689 | 13130 | COMPARATIVE EXAMPLE |
| 30 | 643 | 687 | 13892 | COMPARATIVE EXAMPLE |
| 31 | 737 | 785 | 17620 | COMPARATIVE EXAMPLE |
| 32 | 750 | 804 | 17125 | COMPARATIVE EXAMPLE |
| 33 | 723 | 767 | 16949 | COMPARATIVE EXAMPLE |
| 34 | 747 | 762 | 14215 | COMPARATIVE EXAMPLE |
| 35 | 735 | 801 | 16393 | COMPARATIVE EXAMPLE |
| 36 | 551 | 640 | 17095 | COMPARATIVE EXAMPLE |
| 37 | 638 | 725 | 15882 | COMPARATIVE EXAMPLE |
| 38 | 695 | 727 | 19438 | COMPARATIVE EXAMPLE |
| 39 | 565 | 679 | 17145 | COMPARATIVE EXAMPLE |
| 40 | 601 | 745 | 15754 | COMPARATIVE EXAMPLE |
| 41 | 566 | 673 | 18157 | COMPARATIVE EXAMPLE |
| 42 | 655 | 700 | 19520 | COMPARATIVE EXAMPLE |
| 43 | 642 | 703 | 19560 | COMPARATIVE EXAMPLE |
| 44 | 547 | 650 | 19535 | COMPARATIVE EXAMPLE |
| 45 | 642 | 686 | 19600 | COMPARATIVE EXAMPLE |
| 46 | 643 | 696 | 19595 | COMPARATIVE EXAMPLE |
| 47 | 480 | 594 | 13415 | COMPARATIVE EXAMPLE |

In the present invention examples (Test No. 1 to 21), the tensile strength of 480 MPa or more and the product of the tensile strength and the limit form height in the saddle-type stretch-flange test of 19500 mm·MPa or more were obtained.

Test No. 22 to 27 each are a comparative example in which the chemical composition is out of the range of the present invention. Test No. 28 to 47 each are a comparative example in which the manufacturing conditions were out of a desirable range, and thus one or more of the structures observed by an optical microscope, the proportion of the crystal grains each having an intragranular misorientation of 5 to 14°, the average grain size of cementite, the grain boundary number density of the solid-solution C, and the grain boundary number density of the total of the solid-solution C and the solid-solution B did not satisfy the range of the present invention. In these examples, the index of the stretch flangeability did not satisfy the target value or peeling occurred. Further, in some of the examples, the tensile strength also decreased.

INDUSTRIAL APPLICABILITY

According to the present invention, it is possible to provide a high-strength hot-rolled steel sheet excellent in stretch flangeability that is applicable to members required to have strict stretch flangeability while having high strength. This steel sheet contributes to improvement of fuel efficiency and so on of automobiles, and thus has high industrial applicability.

The invention claimed is:

1. A steel sheet, comprising:

a chemical composition represented by, in mass %,

C: 0.008 to 0.150%,

Si: 0.01 to 1.70%,

Mn: 0.60 to 2.50%,

Al: 0.010 to 0.60%,

Ti: 0 to 0.200%,

Nb: 0 to 0.200%,

Ti+Nb: 0.015 to 0.200%,

Cr: 0 to 1.0%,
B: 0 to 0.10%,
Mo: 0 to 1.0%,
Cu: 0 to 2.0%,
Ni: 0 to 2.0%,
Mg: 0 to 0.05%,
REM: 0 to 0.05%,
Ca: 0 to 0.05%,
Zr: 0 to 0.05%,
P: 0.05% or less,
S: 0.0200% or less,
N: 0.0060% or less, and
balance: Fe and impurities; and
a structure represented by, by area ratio,
ferrite: 0 to 30%, and
bainite: 70 to 100%, wherein
a region that is surrounded by a grain boundary having a misorientation of 15° or more and has a circle-equivalent diameter of 0.3 μm or more is defined as a crystal grain, and wherein the proportion of crystal grains each having an intragranular misorientation of 5 to 14° to all crystal grains is 20 to 100% by area ratio,
a grain boundary number density of solid-solution C or a grain boundary number density of the total of solid-solution C and solid-solution B is 1 piece/$nm^2$ or more and 4.5 pieces/$nm^2$ or less, and
an average grain size of cementite precipitated at grain boundaries is 2 μm or less.

2. The steel sheet according to claim 1, wherein
a tensile strength is 480 MPa or more, and
the product of the tensile strength and a limit form height in a saddle-type stretch-flange test is 19500 mm·MPa or more.

3. The steel sheet according to claim 1, wherein
the chemical composition contains, in mass %, one type or more selected from the group consisting of
Cr: 0.05 to 1.0%, and
B: 0.0005 to 0.10%.

4. The steel sheet according to claim 1, wherein
the chemical composition contains, in mass %, one type or more selected from the group consisting of
Mo: 0.01 to 1.0%,
Cu: 0.01 to 2.0%, and
Ni: 0.01% to 2.0%.

5. The steel sheet according to claim 1, wherein
the chemical composition contains, in mass %, one type or more selected from the group consisting of
Ca: 0.0001 to 0.05%,
Mg: 0.0001 to 0.05%,
Zr: 0.0001 to 0.05%, and
REM: 0.0001 to 0.05%.

6. The steel sheet according to claim 1, wherein
a plating layer is formed on a surface of the steel sheet.

7. The plated steel sheet according to claim 6, wherein the plating layer is a hot-dip galvanizing layer.

8. The plated steel sheet according to claim 6, wherein the plating layer is an alloyed hot-dip galvanizing layer.

* * * * *